US007628143B2

(12) United States Patent
Yamada et al.

(10) Patent No.: US 7,628,143 B2
(45) Date of Patent: Dec. 8, 2009

(54) FUEL SUPPLY DEVICE

(75) Inventors: Katsuhisa Yamada, Okazaki (JP); Masaaki Tanaka, Tsu (JP); Chiaki Kawajiri, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/178,077

(22) Filed: Jul. 23, 2008

(65) Prior Publication Data

US 2009/0025690 A1 Jan. 29, 2009

(30) Foreign Application Priority Data

Jul. 23, 2007 (JP) ..... 2007-191141
Apr. 23, 2008 (JP) ..... 2008-112992

(51) Int. Cl.
*F02M 37/00* (2006.01)
*F02M 37/04* (2006.01)

(52) U.S. Cl. ..... 123/509; 123/510

(58) Field of Classification Search ..... 123/509, 123/510

See application file for complete search history.

(56) References Cited

U.S. PATENT DOCUMENTS 5,415,146 A * 5/1995 Tuckey ..... 123/509
5,511,957 A * 4/1996 Tuckey et al. ..... 417/313
5,596,970 A 1/1997 Schoenberg et al.
5,647,328 A * 7/1997 Fournier et al. ..... 123/509
5,922,199 A 7/1999 Hodgkins
6,156,201 A * 12/2000 Ueda et al. ..... 210/416.4
6,174,438 B1 1/2001 Hodgkins et al.
6,206,037 B1 * 3/2001 Murakoshi et al. ..... 137/565.34
6,293,258 B1 * 9/2001 Frank ..... 123/509
6,382,190 B1 * 5/2002 Tanabe et al. ..... 123/509
6,505,641 B1 * 1/2003 Gebert et al. ..... 137/545
6,619,303 B2 * 9/2003 Hultqvist ..... 134/104.1
7,163,003 B2 * 1/2007 Bradford ..... 123/510
2004/0050370 A1 * 3/2004 Deichmann et al. ..... 123/509
2005/0045159 A1 * 3/2005 Honda et al. ..... 123/509
2005/0053500 A1 * 3/2005 Suzuki et al. ..... 417/423.15
2006/0065246 A1 * 3/2006 Zdroik ..... 123/497
2007/0144495 A1 * 6/2007 Teets et al. ..... 123/509
2007/0162211 A1 7/2007 Seksaria et al.
2008/0184971 A1 * 8/2008 Lubinski et al. ..... 123/511

FOREIGN PATENT DOCUMENTS

JP 3-88954 4/1991
JP 38-88954 4/1991

OTHER PUBLICATIONS

Japamese Office Action dated Jun. 12, 2009, issued in corresponding Japanese Application No. 2008-112992, with English translation.

* cited by examiner

*Primary Examiner*—Thomas N Moulis
(74) *Attorney, Agent, or Firm*—Nixon & Vanderhye, PC

(57) ABSTRACT

A fuel supply device includes a subtank in a fuel tank, a fuel pump in the subtank having a first pump unit suctioning fuel in the subtank to supply fuel to an external equipment and a second pump unit suctioning fuel outside the subtank to pump fuel into the subtank, and a filter connected to a first suction port of the first unit and a second suction port of the second unit and filtering supply fuel supplied to the equipment and pump fuel pumped into the subtank. The filter includes a case, a first filter, and a second filter. The first filter in a first passage of the case directing fuel in the subtank into the first port filters the supply fuel. The second filter in a second passage of the case directing fuel outside the subtank into the second port filters the pump fuel.

39 Claims, 13 Drawing Sheets

FUEL SUPPLY DEVICE

CROSS-REFERENCE TO RELATED APPLICATION

This application is based on and incorporates herein by reference Japanese Patent Application No. 2007-191141 filed on Jul. 23, 2007 and Japanese Patent Application No. 2008-112992 filed on Apr. 23, 2008.

BACKGROUND OF THE INVENTION

1. Field of the Invention

The present invention relates to a fuel supply device.

2. Description of Related Art

There is known a fuel supply device for stably supplying fuel even if a remaining amount of the fuel in a fuel tank decreases (for example, refer to U.S. Pat. No. 5,596,970). The fuel supply device in U.S. Pat. No. 5,596,970 is accommodated in the fuel tank. The fuel supply device is provided with a sub tank for accumulating a part of the fuel in the fuel tank, and a fuel pump accommodated in the sub tank. The fuel pump includes a first pump unit for suctioning the fuel in the sub tank to supply the suctioned fuel to a fuel consumption device, and a second pump unit for suctioning fuel outside of the sub tank to pump up the suctioned fuel into the sub tank. Each suction port of the first and second pump units is provided with a filter member equipped with a bag-shaped filter element for trapping foreign matter in the fuel to be suctioned therein.

A tube for pumping-up fuel extends from the suction port of the second pump unit through an opening formed in the sub tank to an outside of the sub tank and the bag-shaped filter element is fixed to an inlet of the pumping-up tube. Therefore, the second pump unit suctions the fuel outside of the sub tank through the bag-shaped filter element and suctions the fuel into the suction port of the second pump unit through the pumping-up tube.

However, the filter member in the conventional fuel supply device has two filter members including a first filter member connected to the suction port of the first pump unit and a second filter member connected to the suction port of the second pump unit.

In this construction, the two filter members are required for manufacturing a single fuel supply device, and use of the two filter members increases the man hour for assembling the fuel supply device, leading to an increase of costs of the fuel supply device.

Further, since the two filter members are respectively provided with the bag-shaped filter elements, a distance between the suction port of the second pump unit and the inlet of the pumping-up tube, that is, a length of a flow passage for pumping-up fuel from the second pump unit is made longer. Therefore, the high suction force is required of the second pump unit.

SUMMARY OF THE INVENTION

The present invention addresses the above disadvantages. Thus, it is a first objective of the present invention to reduce manufacturing costs of a fuel supply device, which includes a fuel pump having a first pump unit for supplying fuel in a sub tank to a fuel consumption device and a second pump unit for pumping up fuel outside the sub tank into the sub tank. In addition, it is a second objective of the present invention to shorten a length of a flow passage for pumping up fuel from a second pump unit, in a fuel supply device, which includes a fuel pump having a first pump unit for supplying fuel in a sub tank to a fuel consumption device and the second pump unit for pumping up fuel outside the sub tank into the sub tank.

To achieve the objective of the present invention, there is provided a fuel supply device configured to supply fuel in a fuel tank to an external unit. The device includes a subtank, a fuel pump, and a filter member. The subtank is accommodated in the fuel tank, and the subtank stores a part of the fuel in the fuel tank. The fuel pump is accommodated in the subtank, and the fuel pump has a first pump unit, which is configured to suction fuel in the subtank thereby to supply fuel to the external unit, and a second pump unit, which is configured to suction fuel outside the subtank thereby to pump fuel into the subtank. The filter member is connected to a first suction port of the first pump unit and a second suction port of the second pump unit and is configured to filter the fuel supplied to the external unit and the fuel pumped into the subtank. The filter member includes a case, a first filter element, and a second filter element. The case has therein a partition wall, which defines a first flow passage and a second flow passage. The first flow passage directs the fuel in the subtank into the first suction port and the second flow passage directs the fuel outside the subtank into the second suction port. The first filter element is disposed in the first flow passage for filtering the fuel supplied to the external unit. The second filter element is disposed in the second flow passage for filtering the fuel pumped into the subtank.

This allows the filter member for fuel supply and the filter member for pumping-up to be united to form a single member. In consequence, the structure of the fuel supply device becomes simple, thus enabling a provision of the inexpensive fuel supply device.

The casing of the filter member may be mounted to a bottom surface of the sub tank in such a manner that a first inlet of the first flow passage is opened to the inside of the sub tank, and a second inlet of the second flow passage projects from the bottom surface of the sub tank to the outside and is opened toward a bottom surface of the fuel tank. According to this construction, since the first inlet is opened to the inside of the sub tank, the first flow passage can introduce the fuel in the sub tank to the first pump unit. Since the second inlet projects from the bottom surface of the sub tank to the outside and is opened toward the bottom surface of the fuel tank, the fuel in the fuel tank can be pumped up to the sub tank as much as possible.

An opening may be formed in the bottom surface of the sub tank and the casing of the filter member may be inserted and fixed into the opening. Since an assembly in a state of mounting the filter member to the fuel pump can be attached to the sub tank only by inserting the casing of the filter member into the opening from one direction, the man hour of assembling the fuel supply device is reduced, enabling a provision of the inexpensive fuel supply device.

A side wall of the casing may be provided with a flange formed therein having an outer diameter larger than the opening and contacting the bottom surface of the sub tank when the casing is inserted into the opening. Further, the first inlet may be formed closer to the sub tank than the flange and the second inlet may be formed closer to the outside of the sub tank than the flange. According to this construction, only by arranging the fuel pump, to which the filter member is attached, toward the bottom surface of the sub tank, positioning of the first and second inlets can be easily carried out.

The first filter element may be arranged in the first inlet and the second filter element may be arranged in the second inlet. According to this construction, since the first and second filter elements both are arranged in the first and second inlets, the casing is always filled with the fuel which has passed through the filter. Thus, it can be restricted that foreign matter is accumulated in the casing.

A fuel passage for performing communication between an outside and an inside of a side wall in the second inlet may be formed in the side wall of the second inlet, and the second filter element may be arranged to cover the second inlet and the fuel passage.

According to this construction, the fuel passage is formed in the side wall of the second inlet and the second filter element is arranged to cover the second inlet and the fuel passage. Therefore, even if the fuel can not be pumped up from the second inlet due to the freezing of the water components, it is possible to pump up the fuel from the fuel passage arranged in the side wall of the second inlet.

To achieve the objective of the present invention, there is also provided a fuel supply device configured to supply fuel in a fuel tank to an external unit. The device includes a subtank, a fuel pump, and a filter member. The subtank is accommodated in the fuel tank, and the subtank stores a part of the fuel in the fuel tank. The fuel pump is accommodated in the subtank, and the fuel pump has a first pump unit, which is configured to suction fuel in the subtank thereby to supply fuel to the external unit, and a second pump unit, which is configured to suction fuel outside the subtank thereby to pump fuel into the subtank. The filter member is connected to a first suction port of the first pump unit for filtering the fuel supplied to the external unit, and is connected to a second suction port of the second pump unit for filtering the fuel pumped into the subtank. The filter member includes a case, a first filter element, and a second filter element. The case has therein a partition wall, which defines a first flow passage and a second flow passage. The first flow passage directs the fuel in the subtank into the first suction port, and the second flow passage directs the fuel outside the subtank into the second suction port through an opening formed on the subtank. The first filter element is disposed in the first flow passage for filtering the fuel supplied to the external unit. The second filter element is disposed to cover the opening for filtering the fuel pumped into the subtank.

This construction allows the filter member for fuel supply and the second flow passage in the filter member for pumping-up to be united to the single casing Therefore, by a simple construction of arranging the second filter element of the filter member for pumping-up to cover the opening, it is possible to filter the fuel for pumping-up. In consequence, the structure of the fuel supply device becomes simple, thus enabling a provision of the inexpensive fuel supply device.

The casing of the filter member may be mounted in the bottom surface of the sub tank in such a manner that a first inlet of the first flow passage is opened to the inside of the sub tank and a second inlet of the second flow passage projects from the bottom surface of the sub tank to the outside and is opened toward a bottom surface of the fuel tank. According to this construction, since the first inlet is opened to the inside of the sub tank, the first flow passage can introduce the fuel in the sub tank to the first pump unit. Since the second inlet projects from the bottom surface of the sub tank to the outside and is opened toward the bottom surface of the fuel tank, the fuel in the fuel tank can be pumped up to the sub tank as much as possible.

An opening may be formed in the bottom surface of the sub tank and the casing of the filter member may be inserted and fixed into the opening. Since an assembly in a state of mounting the filter member to the fuel pump can be attached to the sub tank only by inserting the casing of the filter member into the opening from one direction, the man hour of assembling the fuel supply device is reduced, enabling a provision of the inexpensive fuel supply device.

A side wall of the casing may be provided with a flange formed therein having an outer diameter larger than the opening and contacting the bottom surface of the sub tank when the casing is inserted into the opening. Further, the first inlet may be formed closer to the sub tank than the flange and the second inlet may be formed closer to the outside of the sub tank than the flange. According to this construction, only by arranging the fuel pump, to which the filter member is attached, toward the bottom surface of the sub tank, positioning of the first and second inlets can be easily carried out.

The first filter element may be arranged in the first inlet. According to this construction, since the first filter element is arranged in the first element and the second filter element is arranged to cover the opening, the casing is always filled with the fuel which has passed through the filter. Thus, it can be restricted that foreign matter is accumulated in the casing.

A fuel passage for performing communication between an outside and an inside of a side wall in the second inlet may be formed in the side wall of the second inlet.

According to this construction, the fuel passage is formed in the side wall of the second inlet and the second filter element is arranged to cover the opening. Therefore, even if the fuel can not be pumped up from the second inlet due to the freezing of the water component, it is possible to pump up the fuel which has passed through the filter from the fuel passage arranged in the side wall of the second inlet.

Furthermore, to achieve the objective of the present invention, there is provided a fuel supply device configured to supply fuel in a fuel tank to an external unit. The device includes a subtank, a fuel pump, and a filter member. The subtank is accommodated in the fuel tank, and the subtank stores a part of the fuel in the fuel tank. The fuel pump is accommodated in the subtank, and the fuel pump has a first pump unit, which is configured to suction fuel in the subtank thereby to supply fuel to the external unit, and a second pump unit, which is configured to suction fuel outside the subtank thereby to pump fuel into the subtank. The filter member is connected to a first suction port of the first pump unit for filtering the fuel supplied to the external unit, and is connected to a second suction port of the second pump unit for filtering the fuel pumped into the subtank. The filter member includes a case, a first filter element, and a second filter element. The case has therein a partition wall, which defines a first flow passage and a second flow passage. The first flow passage directs the fuel in the subtank into the first suction port, and the second flow passage directs the fuel outside the subtank into the second suction port through an opening formed on the subtank. The first filter element is configured to filter the fuel supplied to the external unit. The second filter element is disposed in the second flow passage for filtering the fuel pumped into the subtank. The second filter element is disposed such that a surface of the second filter element is generally parallel to an inner surface of the subtank, on which the opening is formed.

This construction allows the first flow passage of the filter member for fuel supply and the filter member for pumping-up to be united to the single casing. In consequence, the structure of the fuel supply device becomes simple, thus enabling a provision of the inexpensive fuel supply device.

Moreover, the second filter element is arranged in parallel with the inner surface of the sub tank in which the opening is formed. Therefore, it is possible to prevent a flow passage length of the second flow passage from being longer due to the arrangement of the second filter element, making it possible to shorten the flow passage length of the second flow passage. That is, it is possible to shorten a flow passage length for pumping-up fuel from the second pump unit.

The first filter element may be arranged in the first flow passage. This allows the filter member for fuel supply and the filter member for pumping-up to be united to form a single member. In consequence, the structure of the fuel supply device becomes simple, thus enabling a provision of the inexpensive fuel supply device.

The first filter element may be arranged in parallel with the second filter element. Therefore, it is possible to prevent a length of the casing in the flow passage direction of the second flow passage from being longer due to the arrangement of the first filter element, making it possible to shorten the flow passage length of the second flow passage. That is, it is possible to shorten a flow passage length for pumping-up fuel from the second pump unit.

The first filter element and the second filter element each may be formed of a sheet-shaped element. Therefore, it is possible to further shorten the flow passage length of the second flow passage. That is, it is possible to further shorten a flow passage length for pumping-up fuel from the second pump unit.

The inner surface of the sub tank may be a bottom surface thereof and the casing of the filter member may be mounted to the bottom surface of the sub tank in such a manner that a first inlet of the first flow passage is opened to the inside of the sub tank, and a second inlet of the second flow passage projects from the bottom surface of the sub tank to the outside and is opened toward a bottom surface of the fuel tank. According to this construction, since the first inlet is opened to the inside of the sub tank, the first flow passage can introduce the fuel in the sub tank to the first pump unit. Since the second inlet projects from the bottom surface of the sub tank to the outside and is opened toward the bottom surface of the fuel tank, the fuel in the fuel tank can be pumped up to the sub tank as much as possible.

The casing of the filter member may be inserted and fixed into the opening. Since an assembly in a state of mounting the filter member to the fuel pump can be attached to the sub tank only by inserting the casing of the filter member into the opening from one direction, the man hour of assembling the fuel supply device is reduced, enabling a provision of the inexpensive fuel supply device.

A side wall of the casing may be provided with a flange formed therein having an outer diameter larger than the opening and contacting the bottom surface of the sub tank when the casing is inserted into the opening. Further, the first inlet may be formed closer to the sub tank than the flange and the second inlet may be formed closer to the outside of the sub tank than the flange. According to this construction, only by arranging the fuel pump, to which the filter member is attached, toward the bottom surface of the sub tank, positioning of the first and second inlets can be easily carried out.

The first filter element may be arranged in the first inlet and the second filter element may be arranged in the second inlet. According to this construction, since the first filter element and the second element are respectively provided in the first inlet and the second inlet, the casing is always filled with the fuel which has passed through the filter. Thus, it can be restricted that foreign matter is accumulated in the casing.

A fuel passage for performing communication between an outside and an inside of a side wall in the second inlet may be formed in the side wall of the second inlet, and the second filter element may be provided to cover the second inlet and the fuel passage.

According to this construction, the fuel passage is formed in the side wall of the second inlet and the second filter element is arranged to cover the second inlet and the fuel passage. Therefore, even if the fuel can not be pumped up from the second inlet due to the freezing of the water component, it is possible to pump up the fuel from the fuel passage arranged in the side wall of the second inlet.

The first suction port and the second suction port of the fuel pump may be formed in one end of the fuel pump, and a first outlet of the first flow passage connected to the first suction port and a second outlet of the second flow passage connected to the second suction port may be formed in an end facing the one end of the fuel pump.

According to this construction, only by moving the end, in which the first and second outlets are formed, toward one end in which the first and second suction ports of the fuel pump are formed, the connection between the suction port and the outlet can be easily made.

A check valve may be provided in the second flow passage for permitting only flow of the fuel from an outside to an inside of the sub tank. According to this construction, it is possible to restrict that the fuel pumped up in the sub tank flows out again through the second flow passage to the outside of the sub tank.

The check valve may be provided downstream of the second filter element. According to this construction, it is possible to restrict occurrence of functional degradation of the check valve due to the entering of the foreign matter contained in the fuel into a space between a valve body and a valve seat of the check valve.

The casing may comprise an upper casing including an upper partition wall and a lower casing including a lower partition wall to form the casing by being assembled with the upper casing. The upper partition wall and the lower partition wall may form a partition wall as a result of forming the casing by assembling the upper casing and the lower casing with each other to form the casing.

According to this construction, the upper partition wall is provided in the upper casing and the lower partition wall is provided in the lower casing to form the casing by assembling the upper casing and the lower casing. Thus the upper partition wall and the lower partition wall form the partition wall. With this construction, the single casing in which the first and second flow passages are formed by providing the partition wall inside the single casing can be of a simple structure. In consequence, the structure of the fuel supply device becomes simple, thus enabling a provision of the inexpensive fuel supply device.

The upper casing and the lower casing may be assembled with each other by press-fitting to form the casing. According to this construction, since the upper casing and the lower casing are assembled with each other by the press-fitting, the single casing in which the first and second flow passages are formed can be constructed more easily. In consequence, the structure of the fuel supply device becomes simple, thus enabling a provision of the inexpensive fuel supply device.

The second filter element may have a filter area larger than that of the first filter element.

According to this construction, since the second filter element has the filter area larger than that of the first filter element, it can be restricted that the filtering capability of the second filter element is more quickly degraded as compared to that of the first filter element.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
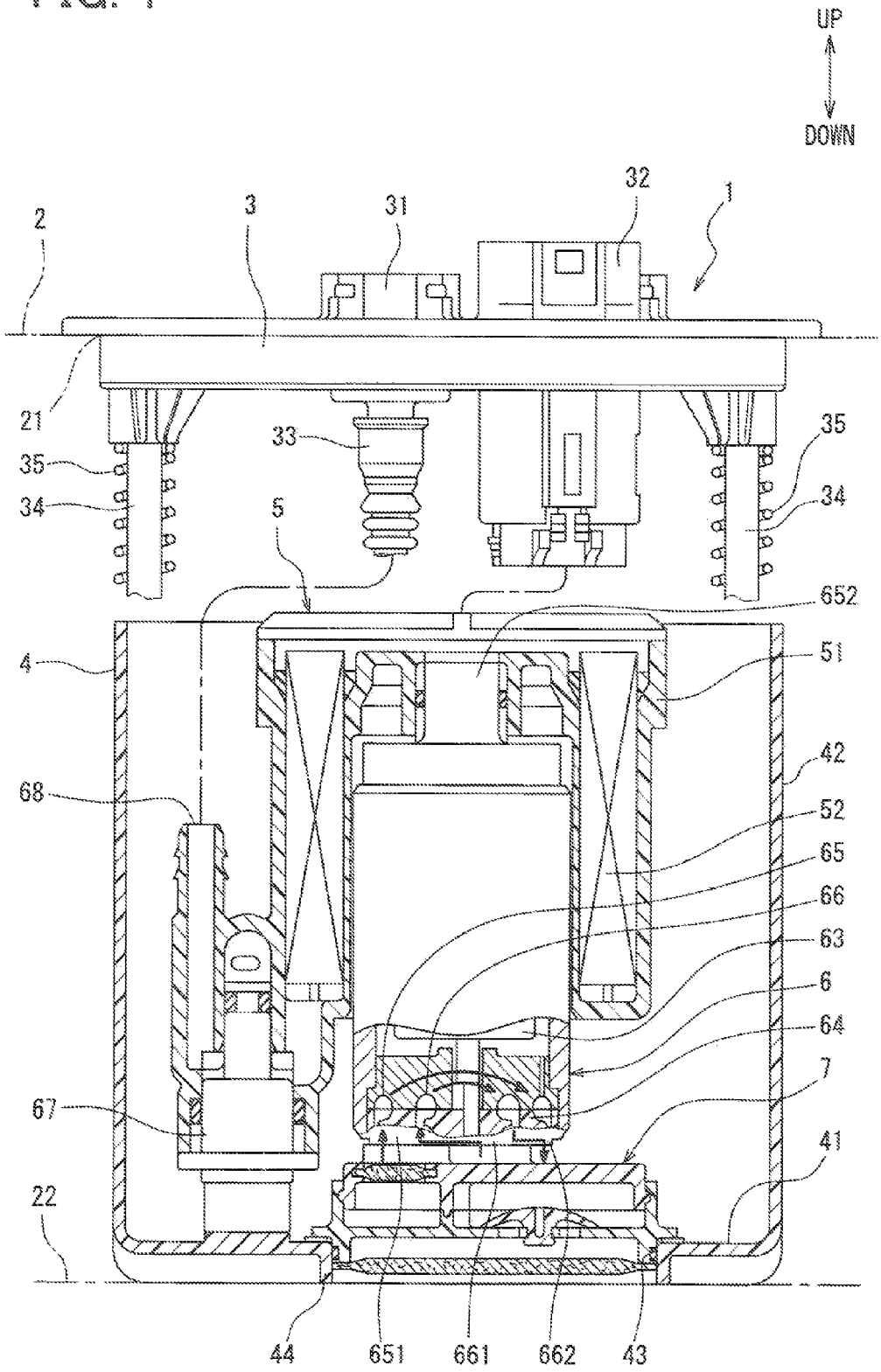
FIG. 1 is a sectional view showing a fuel supply device according to a first embodiment of the invention.

Hereinafter, plural embodiments of the present invention will be explained with reference with the drawings. It should be noted that in the following embodiments, components identical or equivalent to each other are referred to as identical codes in the drawings.

FIRST EMBODIMENT

FIG. 1 is a sectional view showing a state where a fuel supply device 1 is arranged in a fuel tank 2. The upward-downward direction shown in an arrow in FIG. 1 shows the gravity direction in a state where the fuel tank 2 is mounted in a vehicle. The fuel supply device 1 is a device for supplying fuel in the fuel tank 2 to a fuel consumption device (for example, internal combustion engine). As shown in FIG. 1, the fuel supply device 1 is inserted from an opening 21 of the fuel tank 2 into the fuel tank 2 to be arranged therein and is located on the bottom surface 22 of the fuel tank 2. A flange 3 is attached on the opening 21 to close the opening 21 therewith.

The fuel supply device 1 is constructed by attaching a pump unit 5 and the like to a sub tank 4 accommodated in the fuel tank 2. The sub tank 4 is jointed to the flange 3 with shafts 34.

The flange 3 is made of a resin and is formed substantially in a disc-shape. The flange 3 is resin-molded integrally with a fuel discharge pipe 31 and an electric connector 32. The fuel discharge pipe 31 is connected through a hose 33 to the pump unit 5 accommodated in the sub tank 4 and supplies the fuel discharged from the pump unit 5 to the internal combustion engine outside of the fuel tank 2.

The electric connector 32 is electrically connected to an electric connector (not shown) provided in the pump unit 5 through a lead wire and a power supply connector (not shown) to supply the power to the pump unit 5.

The sub tank 4 is made of a resin and includes a bottom surface 41 formed substantially in a disc shape and a side wall 42 extending upwards from an outer peripheral edge of the bottom surface 41. The sub tank 4 accumulates a part of the fuel in the fuel tank 2. The side wall 42 has an inner wall surface provided with insert portions (not shown) into which the shafts 34 that are fixed to an end of the flange 3 on the sub tank 4 side by press-fitting are inserted. The shafts 34 are inserted so as to be movable in an axial direction in the insert portions.

Coil springs 35 are provided between the flange 3 and the sub tank 4 for urging the sub tank 4 downwards to press down the sub tank 4 against the bottom surface 22 of the fuel tank 2. The coil spring 35 has one end supported by the flange 3 and the other end supported by the insert portion of the sub tank 4.

Accordingly, even if a distance between the opening 21 and the bottom surface 22 of the fuel tank 2 varies because the fuel tank 2 made of a resin expands or contracts due to a change in inner pressure by a temperature change or a change in fuel amount, the sub tank 4 can follow the position variation of the bottom surface 22.

An opening 43 is formed on the bottom surface 41 of the sub tank 4. A leg 44 extending toward the bottom surface 22 of the fuel tank 2 is formed in the circumference of the opening 43. A filter assembly 7 as a filter member is inserted into the opening 43.

The pump unit 5 is supported by the side wall 42 of the sub tank 4 through a support mechanism (not shown). The pump unit 5 includes a fuel pump 6, a fuel filter 52, a pressure regulator 67 and the filter assembly 7. The fuel pump 6 includes a supply pump unit 65 as a first pump unit which suctions the fuel in the sub tank 4 and supplies the suctioned fuel to the internal combustion engine, a pumping unit 66 as a second pump unit which pumps up the fuel outside of the sub tank 4 to an inside of the sub tank 4, and a electric motor 63 driving both of the pump units 65 and 66.

Each of the supply pump unit 65 and the pumping unit 66 is provided with a flow passage formed therein. One vane is accommodated in each of the flow passages. The vane is formed in one impeller 64 having a disc shape and the impeller 64 is rotated by the electric motor 63. When the impeller 64 is rotated, the fuel suctioned in the flow passage is increased in pressure.

A supply pump suction port 651 as a first suction port communicated with the flow passage of the supply pump unit 65 is formed in a lower end of the fuel pump 6, and a pumping suction port 661 as a second suction port communicated with the flow passage of the pumping unit 66 is formed in parallel with the supply pump suction port 651. A pumping discharge port 662 for discharging the fuel pumped up by the pumping unit 66 to an inside of the sub tank 4 is formed in the lower end of the fuel pump 6 in addition to the two suction ports 651 and 661. A supply pump discharge port 652 discharging the fuel pumped up by the supply pump unit 65 is formed in the upper end of the fuel pump 6.

The filter assembly 7 is attached to the lower end of the fuel pump 6 for filtering the fuel suctioned from the supply pump suction port 651 and the pumping suction port 661. When the impeller 64 is rotated by operating the electric motor 63, suction forces are generated in the supply pump unit 65 and the pumping unit 66. Then, the fuel outside of the sub tank 4 is suctioned through the filter assembly 7 into the supply pump suction port 651 and the fuel outside of the sub tank 4 is suctioned through the filter assembly 7 into the pumping suction port 661.

The fuel suctioned from the supply pump suction port 651 is discharged from the supply pump discharge port 652 and is supplied to the fuel filter 52. The fuel suctioned from the pumping suction port 661 is discharged from the pumping discharge port 662 and is supplied to the inside of the sub tank 4.

The filter casing 51 accommodates therein the fuel filter 52 for filtering the fuel discharged from the supply pump discharge port 652. The filter casing 51 is made of a resin and has a space having a substantially annular shape for accommodating the fuel filter 52. The filter casing 51 is constructed to have a space further on the inner peripheral side from the substantially annular space for accommodating the fuel pump 6. The upper end of the filter casing 51 has a connection portion connected to the supply pump discharge port 652. The connection portion and the space having the substantially annular shape are communicated through the fuel passage and the fuel discharged from the supply pump discharge port 652 is supplied to the fuel filter 52.

A pressure regulator 67 is provided in the lower end of the filter casing 51 more specifically in the lower end of the substantially annular space. The pressure regulator 67 adjusts a pressure of the fuel which has passed through the fuel filter 52. The fuel, pressure of which is adjusted at the pressure regulator 67, is discharged from a discharge port 68 formed in the filter casing 51. The fuel discharged from the discharge port 68 is supplied to the internal combustion engine outside of the fuel tank 2 through the hose 33 and the fuel discharge pipe 31. When a pressure of the fuel discharged from the fuel pump 6 is more than a predetermined value, the extra pressure-fuel flows out from a drain port (not shown) of the pressure regulator 67 and is returned to the inside of the sub tank 4.

Next, the filter assembly 7 will be explained with reference to FIGS. 2 to 4.

The filter assembly 7 is connected to the fuel pump 6 and filters the fuel suctioned by the supply pump unit 65 and the fuel suctioned by the pumping unit 66 of the fuel pump 6 with a single component.

Figure 2:
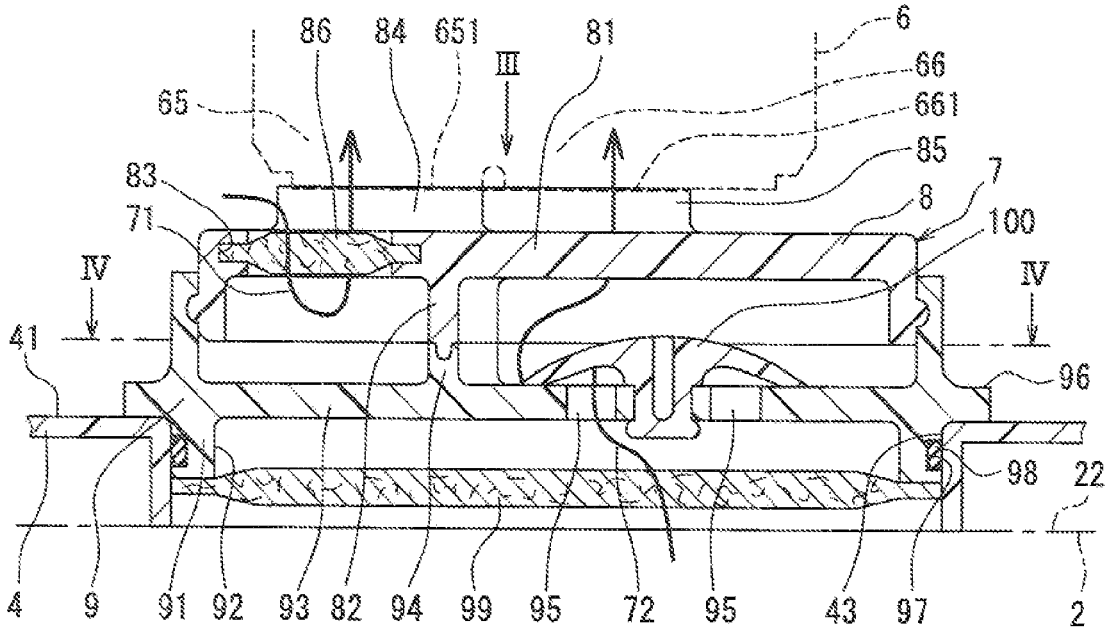
FIG. 2 is a sectional view showing a filter assembly according to the first embodiment.
Figure 3:
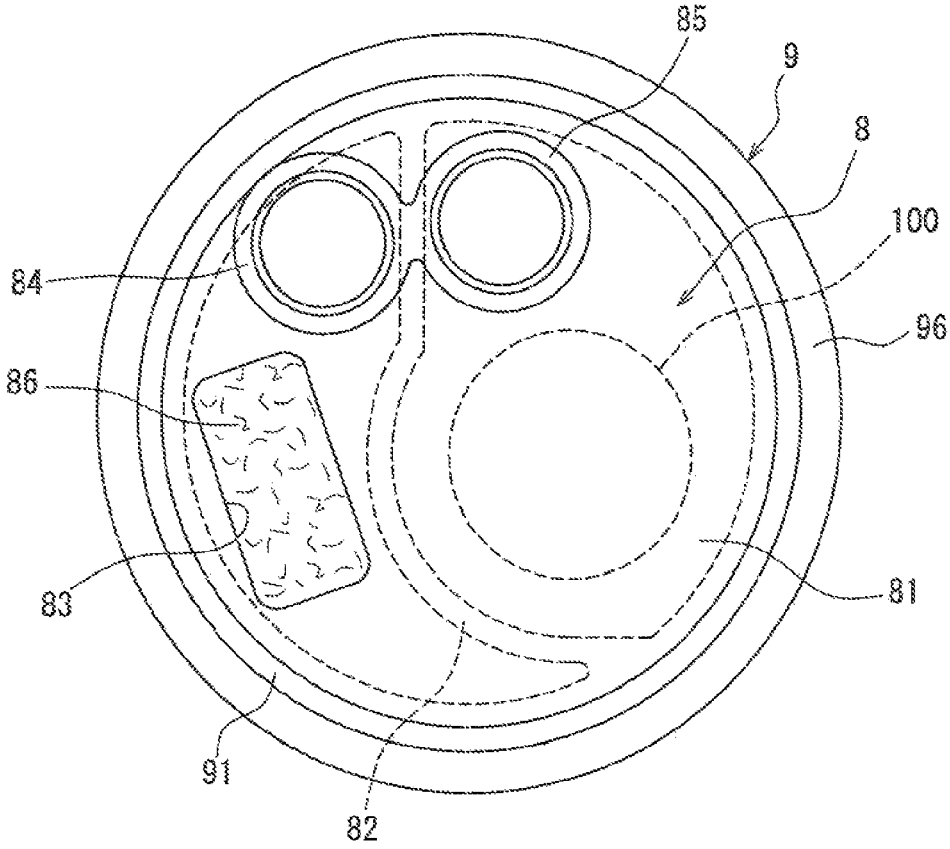
FIG. 3 is a diagram illustrating the filter assembly viewed from a direction III in FIG. 2.

The filter assembly 7 is made of a resin and, as shown in FIG. 2, has an upper casing 8 and a lower casing 9. The lower casing 9 includes a cylindrical portion 91 whose ends in the upward-downward direction are opened, and a first partition wall 93 for partitioning the cylindrical portion 91 into upper and lower portions is formed substantially near the central portion of the cylindrical portion 91. A flange 96 extending in the outer peripheral direction of the cylindrical portion 91 is formed on the outer wall surface substantially near the central portion of the cylindrical portion 91.

The cylindrical portion 91 on a lower side from the flange 96 can be inserted into the opening 43 formed in the bottom surface 41 of the sub tank 4. A groove portion 97 is formed on the outer wall surface of the cylindrical portion 91 contacting the opening 43. An O-ring 98 is attached to the groove portion 97 for securing sealing properties between the cylindrical portion 91 and the opening 43.

The lower opening 92 on the lower side of the cylindrical portion 91 projects outside from the bottom surface 41 and is opened toward the bottom surface 22 of the fuel tank 2 when the lower casing 9 is inserted into the opening 43 of the sub tank 4. A pumping-up fuel filter 99 as the second filter element is provided in the opening 43. The pumping-up fuel filter 99 is formed in a sheet shape, for example, of substantially disc-shaped non-woven cloth and is jointed to the outer peripheral edge of the lower opening 92 by welding. The pumping-up fuel filter 99 is arranged substantially in parallel with the bottom surface 41 of the sub tank 4 in which the opening 43 is formed.

The pumping-up fuel filter 99 is made by fiberizing a resin such as polyester, nylon, polypropylene or acetylene. Since such a material has a relatively high durability against the fuel, a lifetime of the filter assembly 7 can be lengthened by using the material as the pumping-up fuel filter 99.

Figure 4:
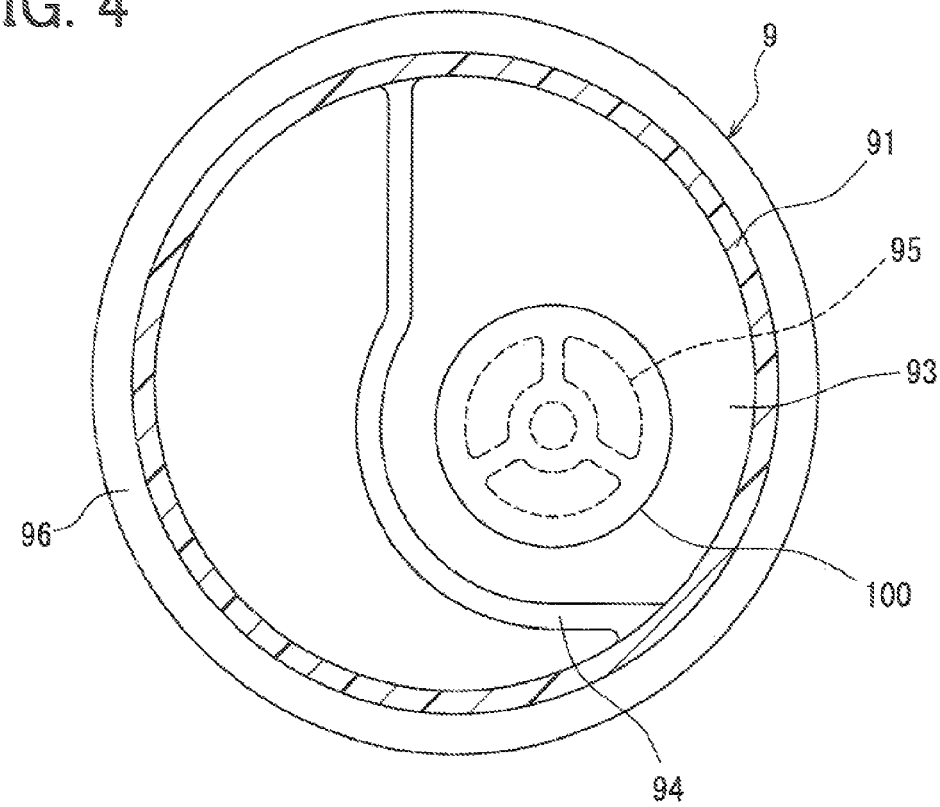
FIG. 4 is a cross section illustrating the filter assembly taken along a line IV-IV in FIG. 2.

As shown in FIGS. 2 and 4, a projection 94 is formed on an upper surface of the first partition wall 93 for partitioning the upper surface into a left surface and a right surface. In FIGS. 2 and 4, through bores 95 penetrating the first partition wall 93 are formed in parallel in the circumference direction in the right surface from the projection 94. A check valve 100 permitting only the flow of the fuel from the lower side toward the upper side of the cylindrical portion 91 is further provided on the right surface.

The check valve 100 is, as shown in FIG. 2, formed in an umbrella shape and is configured in such a manner that a portion of the check valve 100 corresponding to a handle of the umbrella is inserted into a bore of the first partition wall 93 and a portion thereof corresponding to an outer peripheral portion of the umbrella is in contact with the upper surface of the first partition wall 93. Accordingly, the through bores 95 are closed.

When a fuel pressure on a lower side of the through bore 95 is higher than that on an upper side thereof, the check valve 100 is detached from the upper surface of the first partition wall 93 and fuel on a lower side of the first partition wall 93 flows into the upper side through the through bore 95.

The upper casing 8 is formed to close an upper opening of the cylindrical portion 91 in the lower casing 9. A second partition wall 82 extending toward the projection 94 of the first partition wall 93 is formed on a surface of the upper end 81 of the upper casing 8 opposed to the first partition wall 93 (see a broken line in FIG. 3). By attaching the upper casing 8 to the lower casing 9, as shown in FIG. 2, two spaces are defined by the upper end 81 of the upper casing 8 and the first partition wall 93 of the lower casing 9. The second partition wall 82 corresponds to an upper partition wall, the projection 94 corresponds to a lower partition wall and the second partition wall 82 and the projection 94 correspond to a partition wall.

An upper opening 83 communicating with a left space in FIG. 2 is formed in the upper end 81. A supply fuel filter 86 as the first filter element is provided in the opening 83. The supply fuel filter 86 is also formed in a sheet shape in the same way as the pumping-up fuel filter 99 and is arranged substantially in parallel with the pumping-up fuel filter 99. It should be noted that a filter area of the pumping-up fuel filter 99 is set larger than that of the supply fuel filter 86. That is, as shown in FIGS. 2 and 3, a size of the pumping-up fuel filter 99 is set larger than that of the supply fuel filter 86.

The supply fuel filter 86 is formed of non-woven cloth made of the same material as the pumping-up fuel filter 99. The supply fuel filter 86 is jointed to the upper opening 83 by welding or insert molding.

A first connection portion 84 communicating with the left space in FIG. 2 is formed on the upper portion 81. The first connection portion 84 is connected to the supply pump suction port 651 of the fuel pump 6. A second connection portion 85 communicating with the right space in FIG. 2 is formed on the upper end 81. The second connection portion 85 is connected to the pumping suction port 661 of the fuel pump 6.

When the upper casing 8 and the lower casing 9 having the above configuration are assembled, two flow passages are formed in the filter assembly 7. One of them is a supply fuel flow passage 71 as a first flow passage having a first inlet as the upper opening 83 and a first outlet as the first connection portion 84. The other is a pumping-up fuel flow passage 72 as a second flow passage having a second inlet as the lower opening 92 and a second outlet as the second connection portion 85.

Next, a flow of the fuel in the filter assembly 7 generated at the time the fuel pump 6 operates will be explained.

When the fuel pump 6 is activated, suction forces are generated in the supply pump unit 65 and the pumping unit 66. Then, the fuel in the sub tank 4 flows through the supply fuel filter 86 from the upper opening 83 to the supply fuel flow passage 71. The fuel flowing into the supply fuel flow passage 71 is suctioned through the first connection portion 84 into the supply pump suction port 651 of the fuel pump 6.

The fuel outside of the sub tank 4 passes through the opening 43 formed in the sub tank 4 and flows through the pumping-up fuel filter 99 from the lower opening 92 into the pumping-up fuel passage 72. The fuel flowing into the pumping-up fuel flow passage 72 passes through the through bore 95 and is suctioned into the pumping suction port 661 of the fuel pump 6 through the second connection portion 85. That is, it should be understood that the pumping-up fuel flow passage 72 is a flow passage for introducing the fuel outside of the sub tank 4 (in the fuel tank 2) through the opening 43 formed in the sub tank 4 to the pumping suction port 661.

In the present embodiment, unlike the conventional art, the first and second partition walls 93 and 82 and the projection 94 are provided inside the single casing (in a state where the upper casing 8 and the lower casing 9 are assembled) to form the two flow passages (supply fuel flow passage 71 and pumping-up fuel flow passage 72). Further, the filter assembly 7, in which the supply fuel filter 86 and the pumping-up fuel filter 99 are provided to the flow passages 71 and 72 respectively, is connected to the fuel pump 6.

In consequence, as compared to a case where one filter member is provided to each of the suction ports formed in the fuel pump as in the case of the conventional one, the structure of the fuel supply device 1 can be simplified. As a result, the inexpensive fuel supply device can be provided.

In the present embodiment, the second partition wall 82 is provided in the upper casing 8, the projection 94 is provided in the lower casing 9, and the upper casing 8 and the lower casing 9 are attached to each other to form one casing. Thereby, the second partition wall 82 and the projection 94 are configured to form the partition wall. With such a construction, one casing in which the supply fuel flow passage 71 and the pumping-up fuel flow passage 72 are formed by providing the partition wall therein can have a simple structure. In consequence, the structure of the fuel supply device 1 can be simplified and the inexpensive fuel supply device can be provided.

In the present embodiment, the first and second connection portions 84 and 85 are formed in parallel on the upper end 81 of the filter assembly 7. Therefore, in a case where the supply pump suction port 651 and the pumping suction port 661 are formed in parallel at one end of the fuel pump 6, only by moving the filter assembly 7 toward both of the suction ports 651 and 661, both of the connection portions 84 and 85 can be easily connected to both of the suction ports 651 and 661.

Further, since the fitter assembly 7 is fixed by being inserted into the opening 43 formed in the sub tank 4, only by inserting the pump unit 5 in a state where the filter assembly 7 is attached to the end of the fuel pump 6 from the opening side of the sub tank 4, the pump unit 5 can be easily attached to the sub tank 4.

The filter assembly 7 has the flange 96 and is provided with the upper opening 83, which is formed on the upper side of the flange 96 and into which the fuel in the sub tank 4 flows, and the lower opening 92, which is formed on the lower side of the flange 96 and into which the fuel outside of the sub tank 4 flows. Therefore, at the time of attaching the filter assembly 7 to the opening 43 of the sub tank 4, only by inserting the flange 96 until the flange 96 contacts the bottom surface of the sub tank 4, both of the openings 83 and 92 can be arranged at an appropriate position.

The check valve 100 is provided in the midst of the pumping-up fuel flow passage 72 for permitting only the flow of the fuel from the lower opening 92 to the second connection portion 85. Therefore, it can be restricted that the fuel pumped up into the sub tank 4 flows back and flows out of the sub tank 4.

Since the check valve 100 is provided downstream of the pumping-up fuel filter 99, it can restrict the functional degradation of the check valve 100 caused because the foreign matter is sandwiched between the check valve 100 and the first partition wall 93.

In the present embodiment, the supply fuel filter 86 is provided in the upper opening 83 and the pumping-up fuel filter 99 is provided in the lower opening 92. Therefore, the filter assembly 7 is filled with the fuel which has always passed both of the filters 86 and 99 and thereby, it can be restricted that the foreign matter in the fuel is accumulated in the filter assembly 7.

Since the lower opening 92 extends outside from the bottom surface 41 of the sub tank 4 and is opened toward the bottom surface 22 of the fuel tank 2, the fuel in the fuel tank 2 can be pumped up into the sub tank 4 as much as possible.

It should be noted that the second partition wall 82 and the projection 94 may be jointed by an adhesive or the like, but if the pressure loss generated when the fuel passes through a clearance between the second partition wall 82 and the projection 94 is larger than that when the fuel passes through a clearance between the check valve 100 and the first partition wall 93, the second partition wall 82 and the projection 94 may be arranged to be contacted with each other without use of an adhesive or the like, since the outflow of the fuel in the supply fuel flow passage 71 into the pumping-up fuel flow passage 72 through the clearance is restricted.

In FIG. 2, when the pumping-up fuel filter 99 is arranged to be inclined with respect to the bottom surface 41, the flow passage length of the fuel flow passage 72 is made long. Therefore, a high suction force is required in the pumping unit 66. In contrast, in the present embodiment, since the pumping-up fuel filter 99 is arranged substantially in parallel with the bottom surface 41 of the sub tank 4 in which the opening 43 is formed, it can be restricted that the flow passage length of the fuel passage 72 is made longer due to the arrangement of the pumping-up fuel filter 99. That is, since it is possible to shorten the length of the flow passage for pumping-up fuel from the pumping unit 66, it can be restricted that the high suction force is required in the pumping unit 66.

In FIG. 2, when the supply fuel filter 86 is arranged to be inclined with respect to the pumping-up fuel filter 99 arranged substantially in parallel with the bottom surface 411 in the flow passage direction (upward-downward direction in FIG. 2) of the pumping-up fuel flow passage 72, a length of the casing including the upper casing 8 and the lower casing 9 is made long. In contrast, in the present embodiment, the supply fuel filter 86 is arranged to be substantially in parallel with the pumping-up fuel filter 99 arranged substantially in parallel with the bottom surface 41. Therefore, it can be restricted that in the flow passage direction of the pumping-up fuel flow passage 72, the length of the casing including the upper casing 8 and the lower casing 9 is made long due to the arrangement of the supply fuel filter 86. Therefore, the flow passage length of the fuel passage 72 is made shorter. That is, since it is possible to shorten the length of the flow passage for pumping-up fuel from the pumping unit 66, it can be restricted that the high suction force is required in the pumping unit 66.

Since the supply fuel filter 86 and the pumping-up fuel filter 99 are not pouched filters but sheet-shaped filters, the flow passage length of the pumping-up fuel passage 72 can be made shorter That is, since it is possible to further shorten the length of the flow passage for pumping-up fuel from the pumping unit 66, it can be restricted that the high suction force is required in the pumping unit 66.

Since the fuel is filtered through the supply fuel filter 86 after being filtered through the pumping-up fuel filter 99, filtered substances tend to be more easily accumulated in the pumping-up fuel filter 99 as compared to the supply fuel filter 86. Therefore, the filtering capability of the pumping-up fuel filter 99 may be more quickly degraded as compared to that of the supply fuel filter 86.

In the present embodiment, since the pumping-up fuel filter 99 has the filter area larger than that of the supply fuel filter 86, it can be restricted that the filtering capability of the pumping-up fuel filter 99 is more quickly degraded as compared to that of the supply fuel filter 86.

SECOND EMBODIMENT

A second embodiment of the present invention will be explained with reference to FIGS. 5 and 6.

Figure 5:
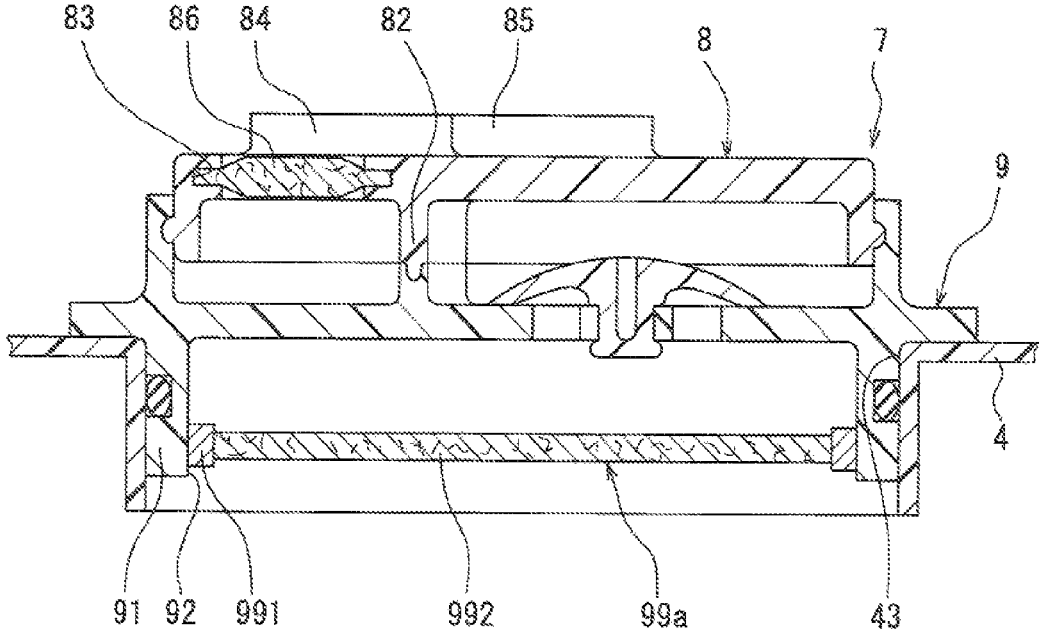
FIG. 5 is a sectional view showing a filter assembly according to a second embodiment of the invention.
Figure 6:
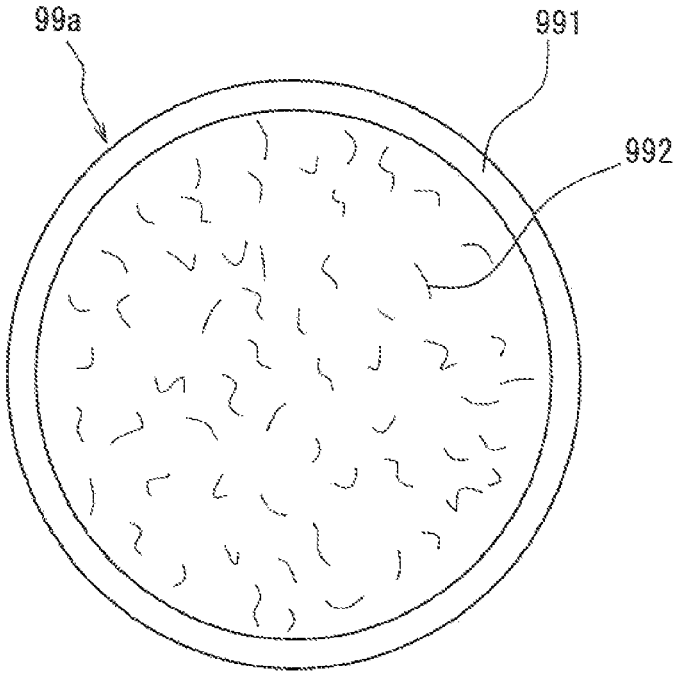
FIG. 6 is a plan view showing a pumping-up fuel filter provided for the filter assembly in FIG. 5.

As shown in FIGS. 5 and 6, a pumping-up fuel filter 99*a* is configured as a result of providing a filter body 992, which is made of non-woven cloth similar to the first embodiment, for a substantially annular ring member 991. The pumping-up fuel filter 99*a* of the present embodiment is fixed by press-fitting the ring member 991 into an inner wall of the cylindrical portion 91 in the lower casing 9. In consequence, the pumping-up fuel filter 99*a* can be easily mounted to the filter assembly 7.

THIRD EMBODIMENT

A third embodiment of the present invention will be explained with reference to FIGS. 7 and 8.

Figure 7:
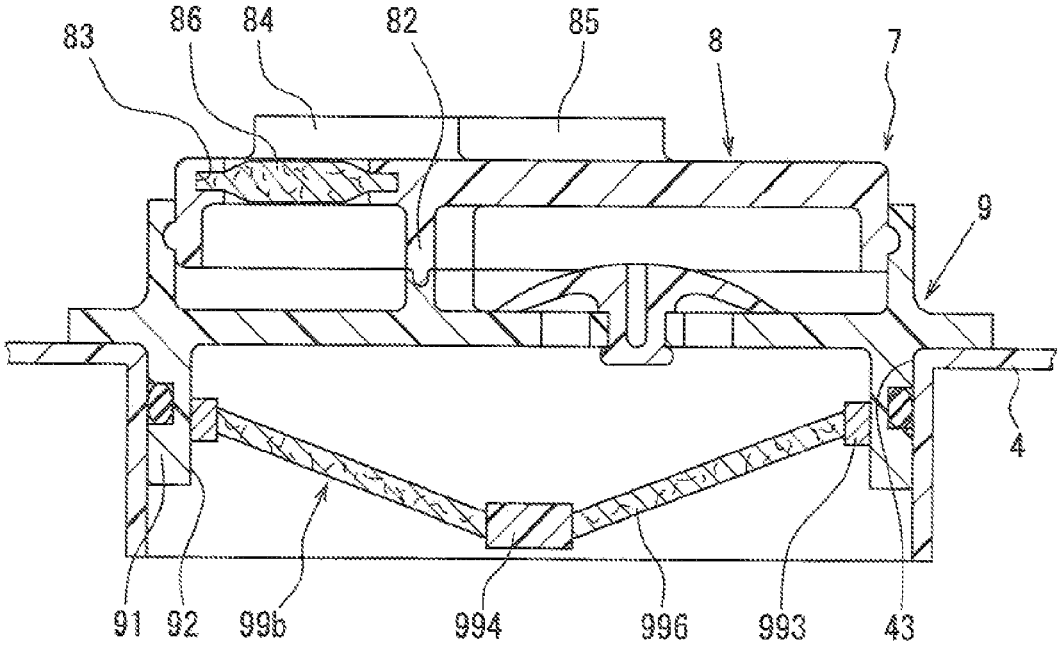
FIG. 7 is a sectional view showing a filter assembly according to a third embodiment of the invention.
Figure 8:
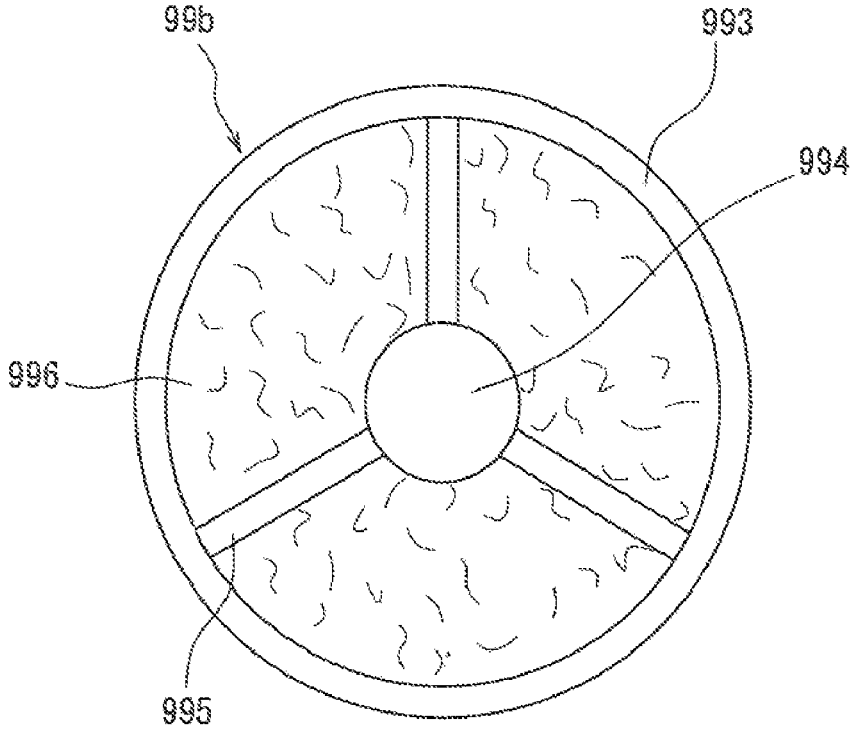
FIG. 8 is a plan view showing a pumping-up fuel filter provided for the filter assembly in FIG. 7.

As shown in FIGS. 7 and 8, a pumping-up fuel filter 99*b* includes a substantially annular ring member 993, a disc member 994 arranged substantially in the center of the ring member 993, and hub members 995 connecting the ring member 993 to the disc member 994. Filter bodies 996 made of non-woven cloth as in the case of the first embodiment are provided in spaces between the ring member 993 and the disc member 994. The pumping-up fuel filter 99*b* of the present embodiment is fixed by press-fitting the ring member 993 into the inner wall of the cylindrical portion 91 in the lower casing 9. In consequence, the pumping-up fuel filter 99*b* can be easily mounted to the filter assembly 7.

The pumping-up fuel filter 99*b* of the present embodiment is configured to support the filter body 996 by the disc member 994 provided in the substantially central portion and the hub member 995. Therefore, the strength of the filter 99*b* is improved.

FOURTH EMBODIMENT

A fourth embodiment of the present invention will be explained with reference to FIGS. 9 and 10.

Figure 9:
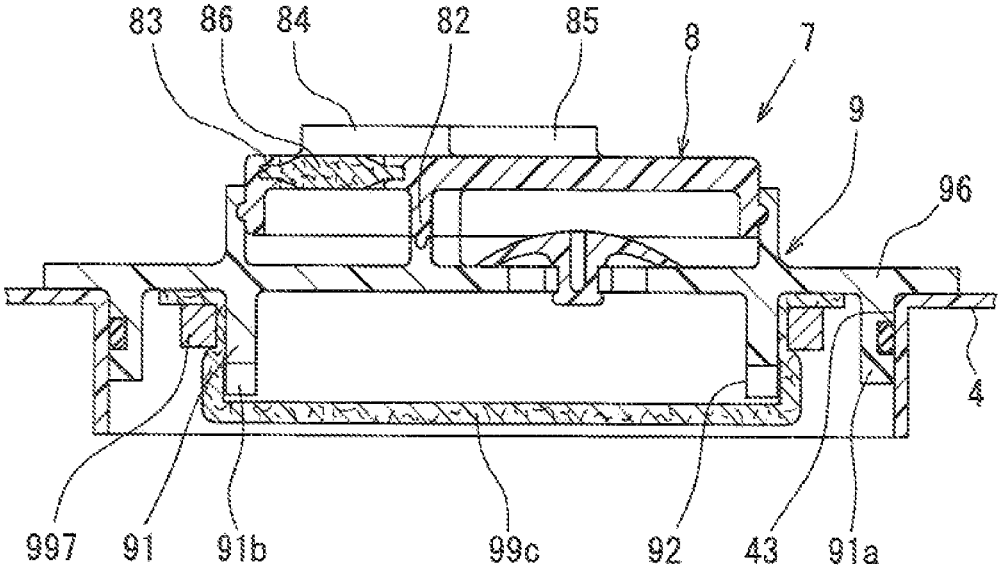
FIG. 9 is a sectional view showing a filter assembly according to a fourth embodiment of the invention.

As shown in FIG. 9, a substantially annular projection 91*a* is formed in the flange 96 of the lower casing 9 on an outer peripheral side from the cylindrical portion 91. The projection 91*a* is supported by the opening 43 of the sub tank 4.

Figure 10:
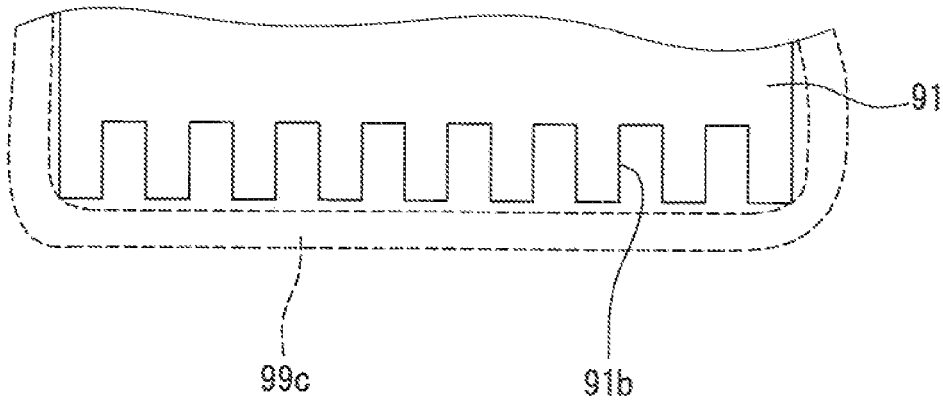
FIG. 10 is a side view showing a main section of the filter assembly in FIG. 9.

As shown in FIG. 10, grooves 91*b* are formed on the side wall near the lower opening 92 of the cylindrical portion 91 for establishing communication between the outer wall and the inner wall of the cylindrical portion 91. The groove 91*b* corresponds to a fuel passage.

A pumping-up fuel filter 99*c* provided on the lower opening 92 is, as shown in FIG. 9, provided to cover the grooves 91*b*. The pumping-up fuel filter 99*c* has an end which is fixed using a plastic ring 997.

Since the water component contained in the fuel has a specific gravity larger than that of the fuel, the water component tends to easily remain in the bottom surface 22 of the fuel tank 2. If the lower opening 92 is opened toward the bottom surface 22 of the fuel tank 2 as in the cases from the first to third embodiments, the fuel may not be suctioned from the lower opening 92 when the water component which has remained on the bottom surface 22 is frozen.

In the filter assembly 7 of the present embodiment, the grooves 91*b* are formed on the side wall of the cylindrical portion 91. Therefore, even if the fuel can not be suctioned from the lower opening 92, the fuel can be suctioned through the grooves 91*b*.

Figure 11:
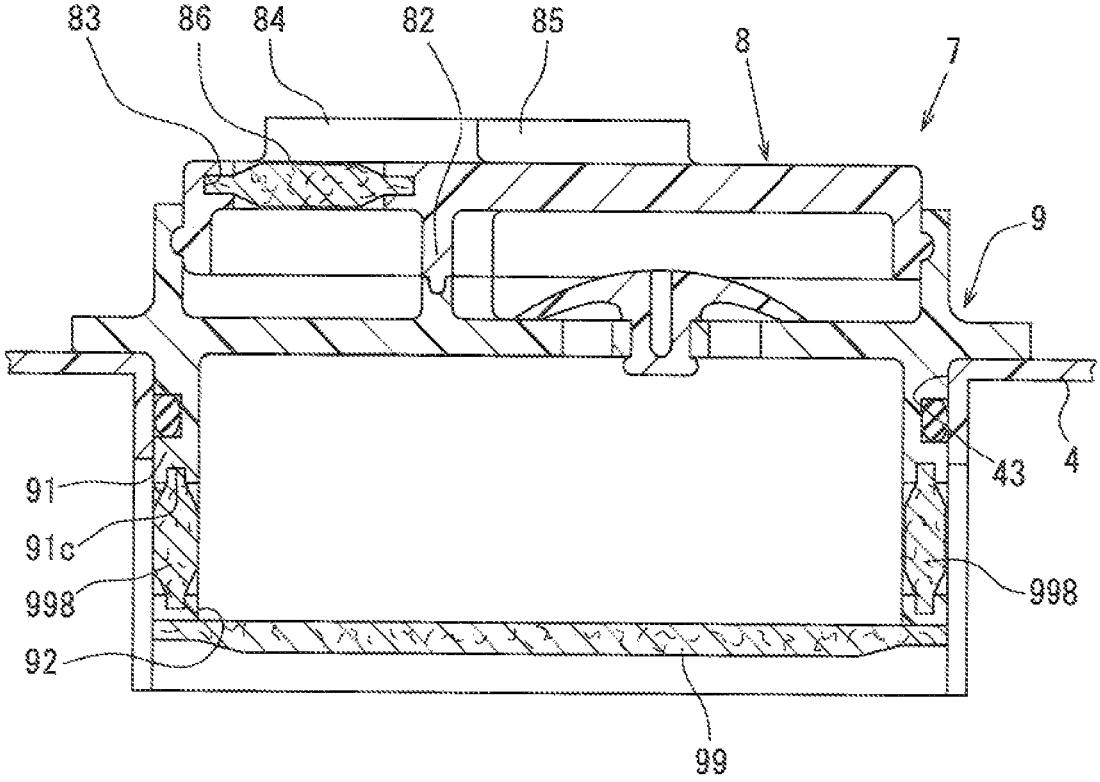
FIG. 11 is a sectional view showing a filter assembly according to a modification on the fourth embodiment.

As shown in FIG. 11, instead of the groove 91*b* shown in FIG. 10, through bores 91*c* may be formed on the side wall of the cylindrical portion 91 and filters 998 different from the pumping-up fuel filter 99 in the lower opening 92 may be provided in the through bores 91*c*.

FIFTH EMBODIMENT

Figure 12:
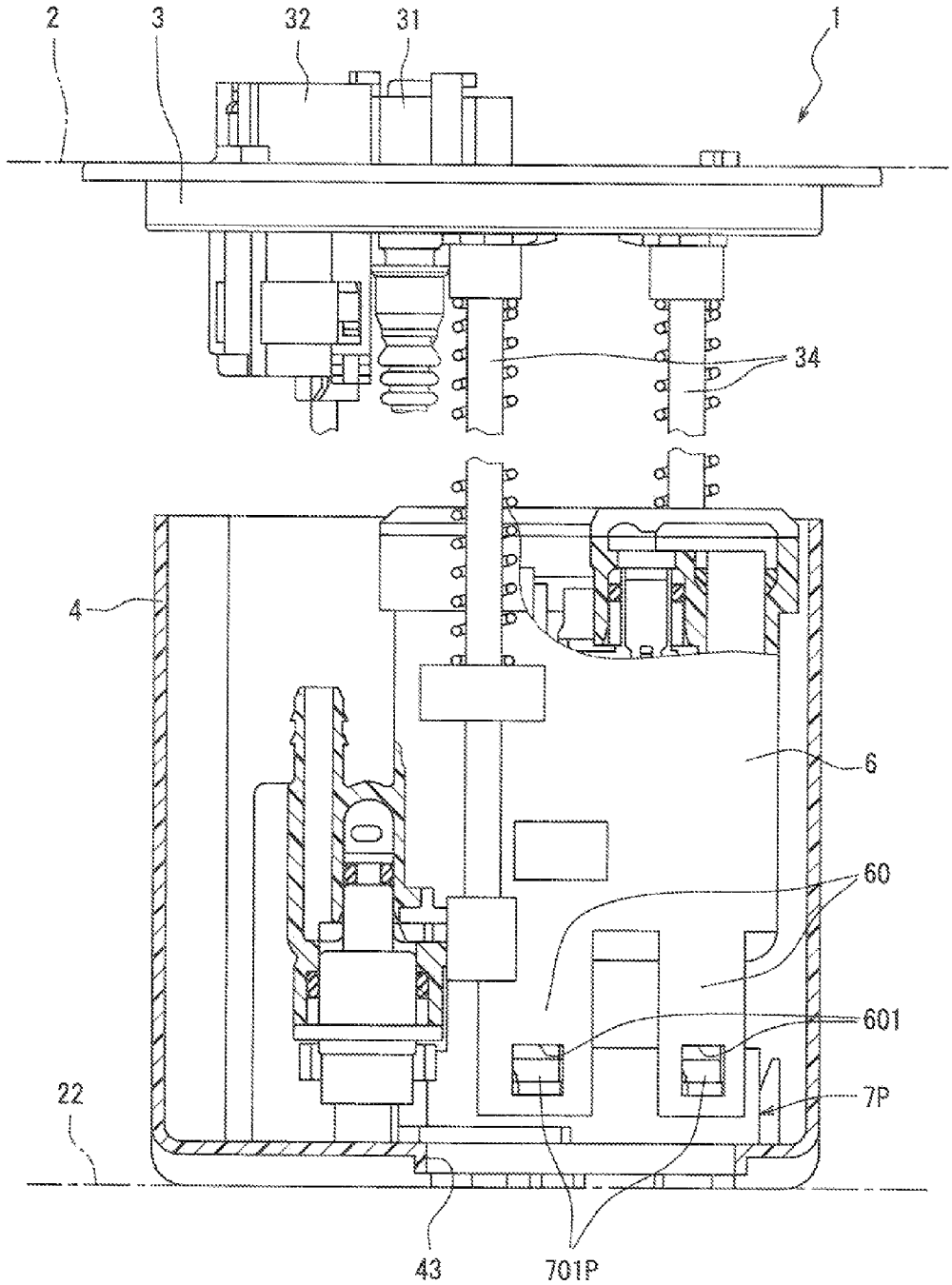
FIG. 12 is a partial sectional view showing a fuel supply device according to a fifth embodiment of the invention.

A fifth embodiment of the present invention will be explained with reference to FIGS. 12 and 16.

Figure 13:
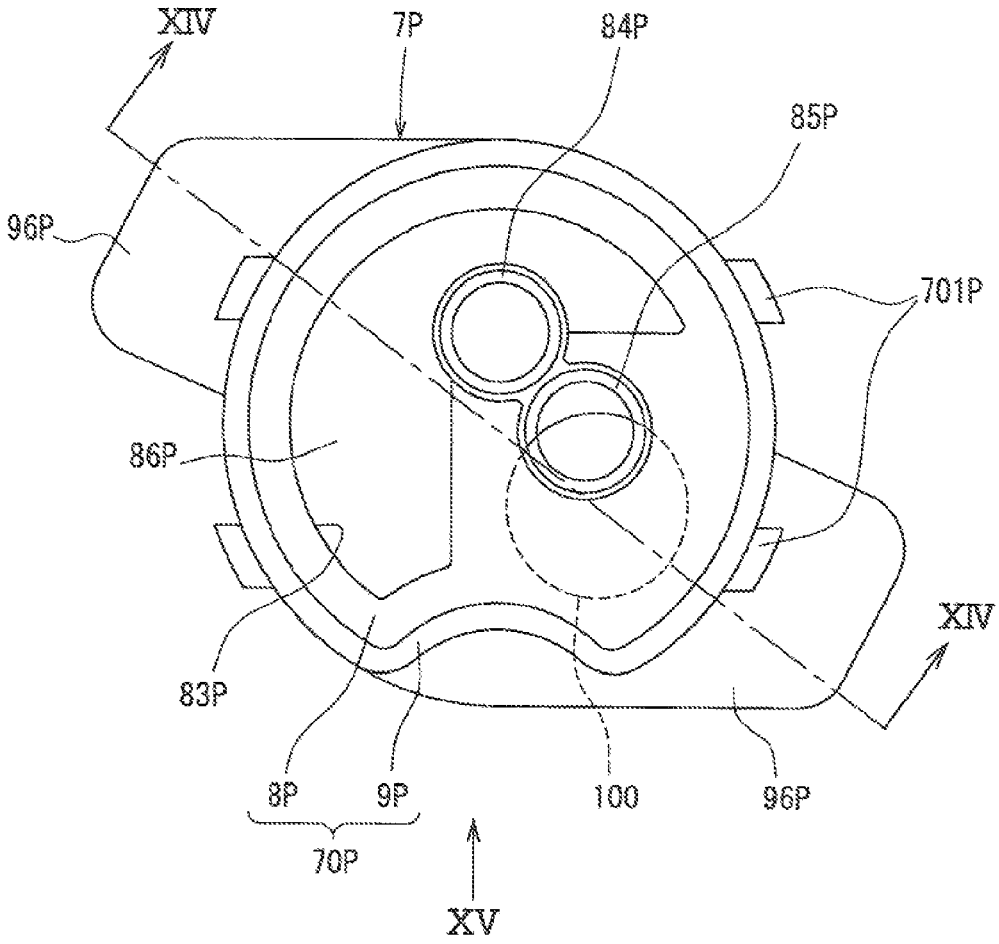
FIG. 13 is a plan view showing a filter assembly according to the fifth embodiment.

In the present embodiment, arm portions 60 in which engaged holes 601 are formed in the lower end of the fuel pump 6, and engagement pawls 701P engaging the engaged holes 601 are formed in a filter assembly 7P. By engaging the engagement nail 701P and the engaged hole 601, the connection between connection portions 84P, 85P of the filter assembly 7P (FIG. 14) and the suction ports 651, 661 of the fuel pump 6 can be secured. The engagement pawls 701P are formed on a lower casing 9P as shown in FIGS. 13 to 15.

Figure 14:
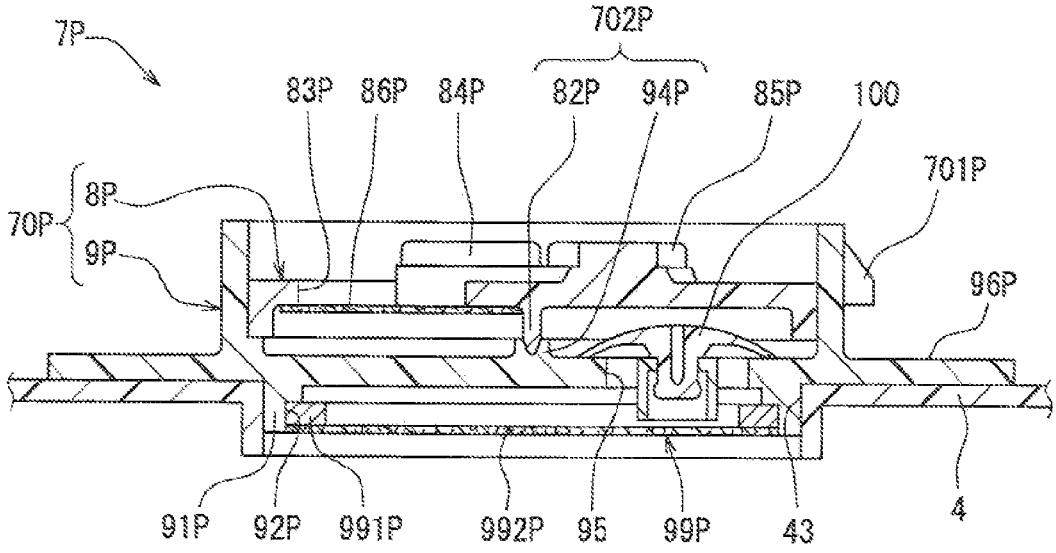
FIG. 14 is a sectional view illustrating the filter assembly taken along a line XIV-XIV in FIG. 13.
Figure 15:
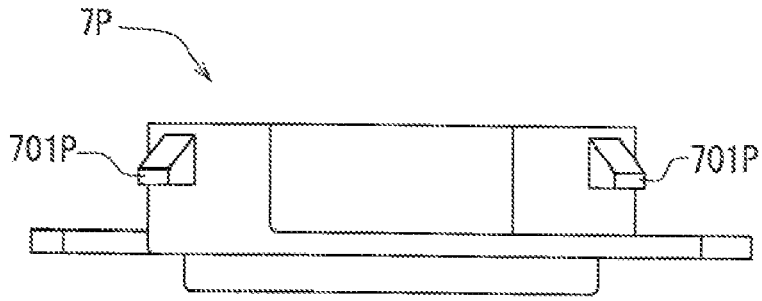
FIG. 15 is a diagram viewed from a direction XV in FIG. 13.

The filter assembly 7P is, as shown in FIG. 14, provided with a casing 70P, a supply fuel filter 86P, a pumping-up fuel filter 99P and the check valve 100. The filter assembly 7P is fixed to the sub tank 4 by press-fitting a cylindrical portion 91P into the opening 43 of the sub tank 4. Along with abolishment of the groove 97 and the O-ring 98, the sealing properties between the cylindrical portion 91P and the opening 43 is secured by the press-fitting.

The casing 70P is formed by press-fitting an upper casing 8P into a lower casing 9P. The sealing properties between the upper casing 8P and the lower casing 9P are secured by the press-fitting. It should be noted that, unlike the cases 8 and 9 of the above embodiments, the upper casing 8P is attached into the lower casing 9P, since the engagement pawl 701P is formed on the lower casing 9P in the present embodiment. A flange 96P is formed on the lower casing 9P.

In the present embodiment, a second partition wall 82P is provided in the upper casing 8P, the projection 94P is provided in the lower casing 9P, and the upper casing 8P and the lower casing 9P are attached to each other to form a casing 70P. Thereby, the second partition wall 82P and the projection 94P form a partition wall 702P. The second partition wall 82P is fitted into the projection 94P, thereby forming the partition wall 702P.

Figure 16:
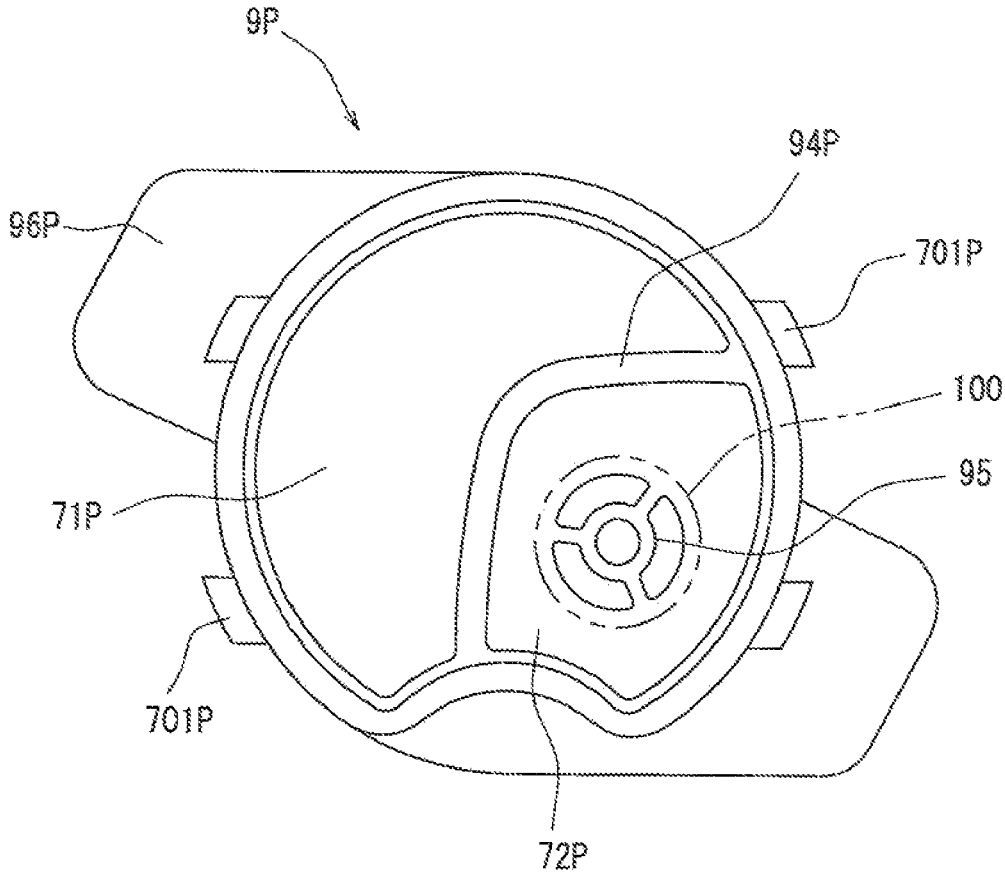
FIG. 16 is a plan view showing a lower casing in FIG. 13.

The projection 94P is formed in a shape shown in FIG. 16 and the second partition wall 82P is also formed in a shape similar to the projection 94P (not shown). As shown in FIG. 16, the lower casing 9P is divided by the projection 94P to form a supply fuel flow passage 71P and a pumping-up fuel flow passage 72P therein. The upper casing 8P is divided by the second partition wall 82P formed in a shape similar to the projection 94P to form the supply fuel flow passage 71P and the pumping-up fuel flow passage 72P therein (not shown).

With such a construction, one casing 70P in which the supply fuel flow passage 71P and the pumping-up fuel flow passage 72P are formed by providing the partition wall 702P therein can have a simple structure. In consequence, the structure of the fuel supply device 1 can be simplified and the inexpensive fuel supply device can be provided.

A pumping-up fuel filter 99P is configured as a result of providing a filter body 992P made of non-woven cloth similar to the first embodiment for a substantially annular ring member 991P like the pumping-up fuel filter 99*a* of the second embodiment. The pumping-up fuel filter 99P of the present embodiment is fixed by press-fitting the ring member 991P into an inner wall (lower opening 92P) of the cylindrical portion 91P in the lower casing 9P. In consequence, the pumping-up fuel filter 99P can be easily mounted to the filter assembly 70P.

The supply fuel filter 86P is also a non-woven cloth made of a material similar to that of the pumping-up fuel filter 99P and, for example, is jointed to the upper opening 83P by welding. It should be noted that the upper opening 83P shown in FIG. 13 is made larger as compared to the upper opening 83 shown in FIG. 3. The upper opening 83P is maximized in size in the supply fuel flow passage 71P and thereby the filter area of the supply fuel filter 86P is made large. By increasing the filter area of the supply fuel filter 86P, a filter lifetime of the supply fuel filter 86P can be lengthened.

SIXTH EMBODIMENT

Figure 17:
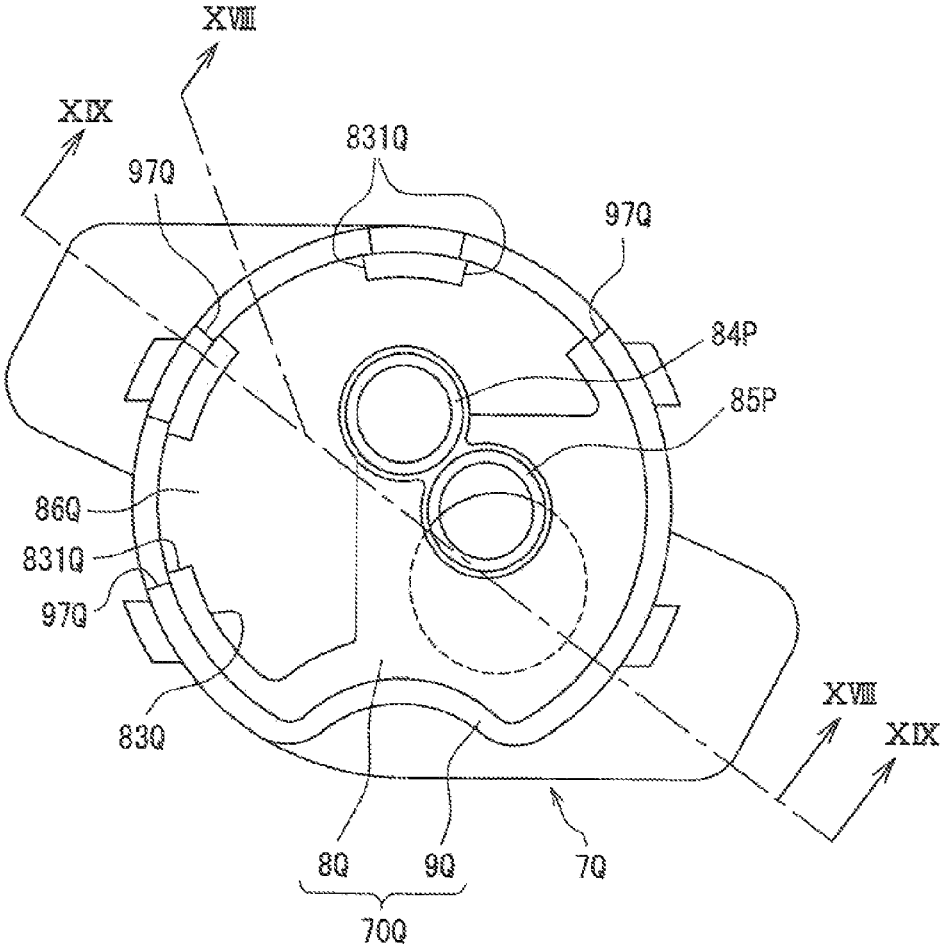
FIG. 17 is a plan view showing a filter assembly according to a sixth embodiment of the invention.
Figure 19:
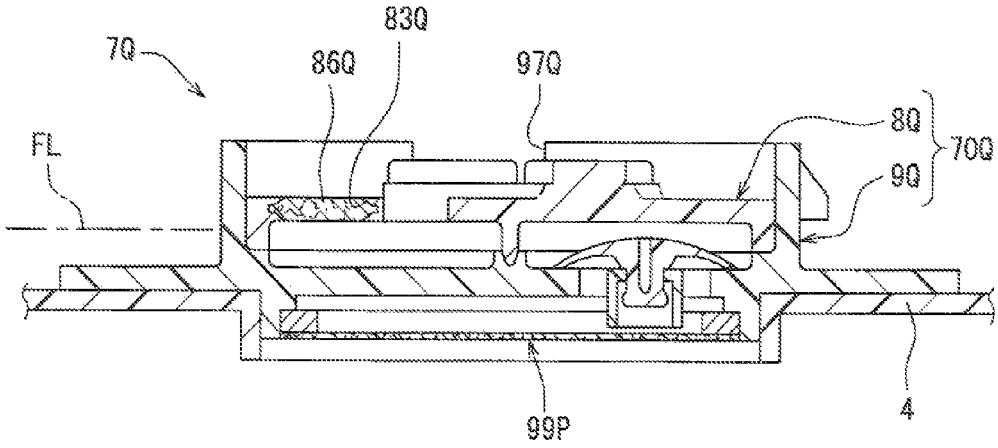
FIG. 19 is a sectional view illustrating the filter assembly taken along a line XIX-XIX in FIG. 17.

A sixth embodiment of the present invention will be explained with reference to FIGS. 17 and 19.

In a filter assembly 7Q of the present embodiment, a supply fuel filter 86Q is a non-woven cloth made of a material similar to that of the filter 86, 99, 86P or 99P, and is jointed at an upper opening 83Q to an upper casing 8Q by insert molding. In a casing 70Q, three notch portions 831Q are provided in the upper opening 83Q of the upper casing 8Q and three notch portions 97Q are provided in a side wall of a lower casing 9Q. In consequence, the supply fuel filter 86Q is exposed from the casing 70Q through the notch portions 831Q and 97Q.

Figure 18:
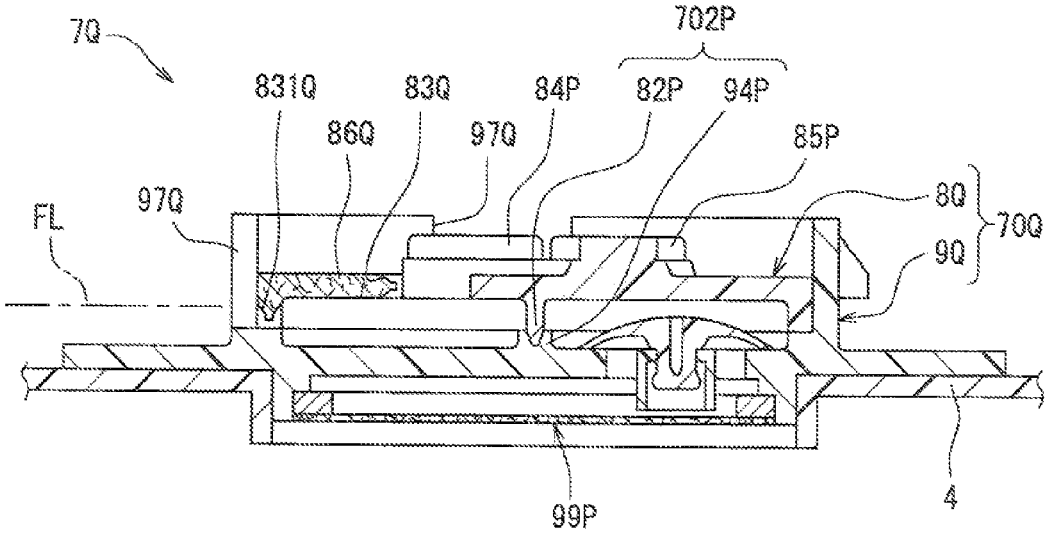
FIG. 18 is a sectional view illustrating the filter assembly taken along a line XVIII-XVIII in FIG. 17.

Even if a liquid surface level of the fuel is lowered to reach level FL as shown in FIG. 18, a part of the supply fuel filter 86Q which is exposed through the notch portions 831Q and 97Q can filter the fuel of level FL, so that the filtered fuel can be supplied to the fuel consumption device. It should be noted that, as shown in FIG. 19, a part of the supply fuel filter 86Q which is not exposed through the notch portions 831Q and 97Q can not filter the fuel of level FL, so that the filtered fuel can not be supplied to the fuel consumption device. However, since the part of the supply fuel filter 86Q which are not exposed through the notch portions 831Q and 97Q is surrounded by the upper casing 8Q, the supply fuel filter 86Q is strongly jointed to the upper casing 8Q.

SEVENTH EMBODIMENT

A seventh embodiment of the present invention will be explained with reference to FIG. 20.

In a filter assembly 7R of the present embodiment, a pumping-up fuel filter 99R is not united to a casing 70R and is provided to cover the opening 43 of a sub tank 4R.

Figure 20:
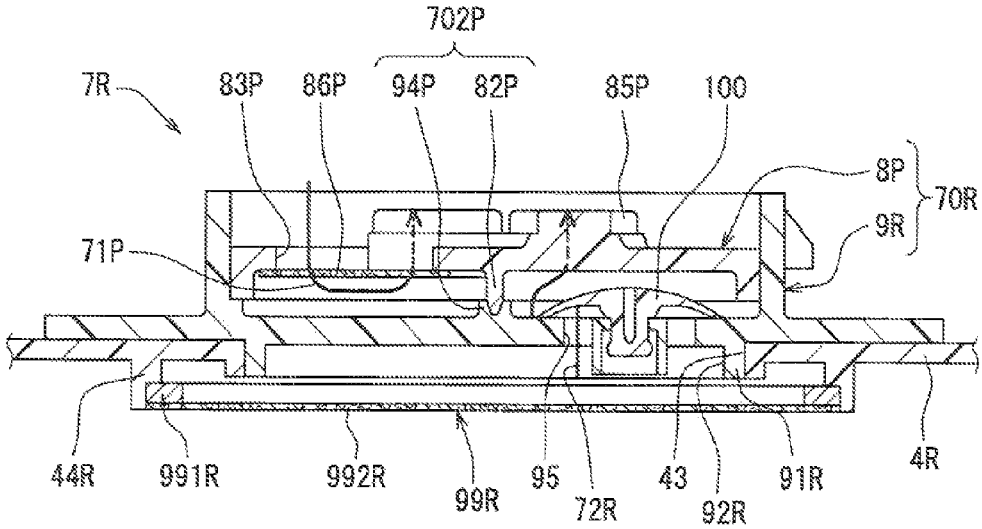
FIG. 20 is a sectional view showing a filter assembly according to a seventh embodiment of the invention.

The filter assembly 7R is, as shown in FIG. 20, provided with the casing 70R, the supply fuel filter 86P and the check valve 100. The filter assembly 7R is fixed to the sub tank 4R by press-fitting a cylindrical portion 91R into the opening 43 of the sub tank 4R. Along with abolishment of the groove 97 and the O-ring 98, the sealing properties between the cylindrical portion 91R and the opening 43 are secured by the press-fitting. It should be noted that, in the present embodiment, the filter member includes the filter assembly 7R and the pumping-up fuel filter 99R.

The casing 70R is formed by press-fitting the upper casing 8P into the lower casing 9R. The sealing properties between the upper casing 8P and the lower casing 9R are secured by the press-fitting. In the present embodiment, the second partition wall 82P is provided in the upper casing 8P, the projection 94P is provided in the lower casing 9R, and the upper casing 8P and the lower casing 9R are attached to each other to form the casing 70R. Thereby, the second partition wall 82P and the projection 94P form the partition wall 702P.

Flow passages 71P and 72R are formed by the partition wall 702P. The pumping-up fuel flow passage 72R is formed in a route from the lower opening 92R via the through bore 95 and the check valve 100 to the second connection portion 85P and introduces the fuel outside of the sub tank 4R (in the fuel tank 2) to the pumping suction port 661 through the opening 43 formed in the sub tank 4R.

The pumping-up fuel filter 99R is a fuel filter having a diameter larger than that of each of the pumping-up fuel filters 99*a* and 99P and is configured as a result of providing a filter body 992R made of non-woven cloth similar to that of the filter bodies 992 and 992P to a substantially annular ring member 991R. The pumping-up fuel filter 99R is not united to the casing 70R and is provided to cover the opening 43 of the sub tank 4R. More specifically, the pumping-up fuel filter 99R is fixed by press-fitting the ring member 991R into an inner wall of a cylindrical portion 44R in the sub tank 4R and is mounted to the sub tank 4R to cover the opening 43.

The supply fuel filter 86P is a non-woven cloth made of a material similar to that of the filter 86, 99, 86P, 99P or 99R and is jointed to the upper opening 83P by insert molding.

In the present embodiment, by providing the partition wall 702P inside the single casing 70R, the two flow passages of the supply fuel flow passage 71P introducing the fuel in the sub tank 4R to the supply pump suction port 651 and the pumping-up fuel flow passage 72R pumping up the fuel outside of the sub tank 4R through the opening 43 of the sub tank 4R and introducing the fuel to the pumping-up pump suction port 661 are formed. Further, the supply fuel filter 86P for filtering the fuel for supply is arranged in the supply fuel flow passage 71P, and the pumping-up fuel filter 99R for filtering the fuel to be pumped-up is provided to cover the opening 43.

This construction allows the filter member for fuel supply (supply fuel flow passage 71P and supply fuel filter 86P) and the pumping-up fuel flow passage 72R of the filter member for pumping-up to be united into the single casing 70R. Therefore, it is possible to filter the fuel to be pumped-up by a simple structure of providing the pumping-up fuel filter 99R of the filter member for pumping-up to cover the opening 43. In consequence, the structure of the fuel supply device becomes simple, thus enabling a provision of the inexpensive fuel supply device 1.

It should be noted that as compared to a diameter of each of the pumping-up fuel filters 99*a* and 99P, a diameter of the pumping-up fuel filter 99R is made larger and a filter area of the pumping-up fuel filter 99R is made larger. This allows a filter lifetime of the pumping-up fuel filter 99R to be lengthened.

EIGHTH EMBODIMENT

Figure 21:
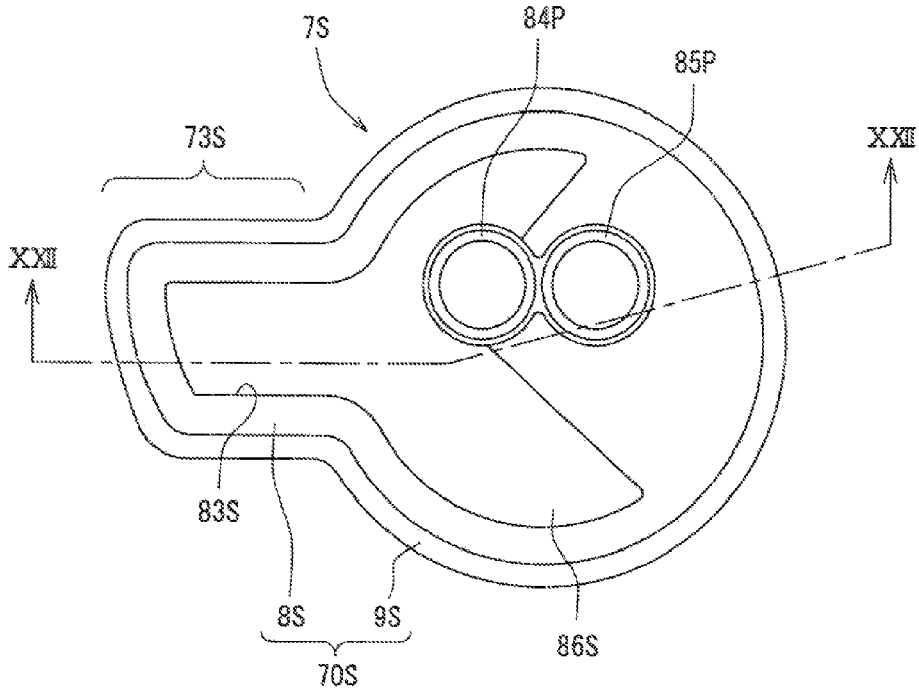
FIG. 21 is a plan view showing a filter assembly according to an eighth embodiment of the invention.

An eighth embodiment of the present invention will be explained with reference to FIGS. 21 to 23.

A filter assembly 7S of the present embodiment is provided with an extending portion 73S extending toward the left side, an upper opening 83S enlarged to the extending portion 73S, and a supply fuel filter 86S enlarged to the extending portion 73S.

Figure 22:
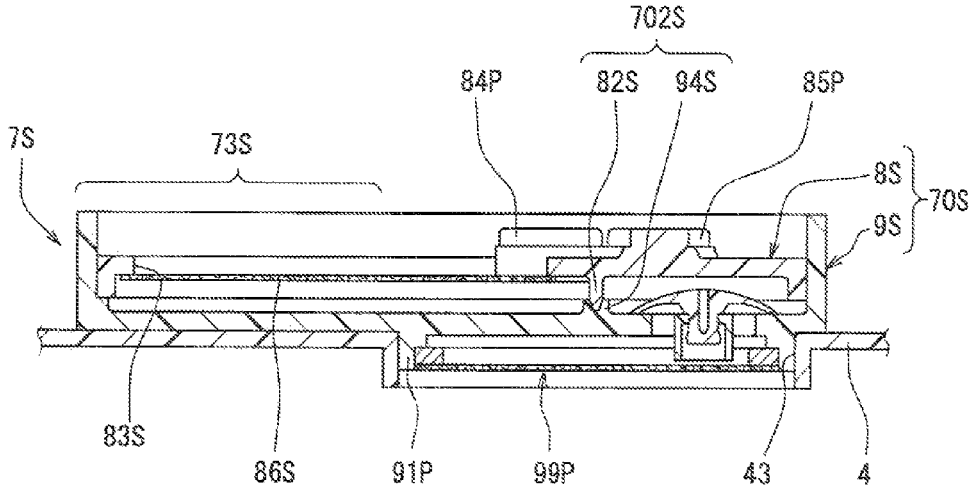
FIG. 22 is a sectional view illustrating the filter assembly taken along a line XXII-XXII in FIG. 21.

The filter assembly 7S is, as shown in FIG. 22, provided with a casing 70S, the supply fuel filter 86S and the pumping-up fuel filter 99R The filter assembly 7S is fixed to the sub tank 4 by press-fitting the cylindrical portion 91P into the opening 43 of the sub tank 4. The casing 70S is formed by press-fitting an upper casing 8S into a lower casing 9S. In the present embodiment, a second partition wall 82S is provided in the upper casing 8S, a projection 94S is provided in the lower casing 9S, and the upper casing 8S and the lower casing 9S are attached to each other to form the casing 70S. Thereby, the second partition wall 82S and the projection 94S form the partition wall 702S.

Figure 23:
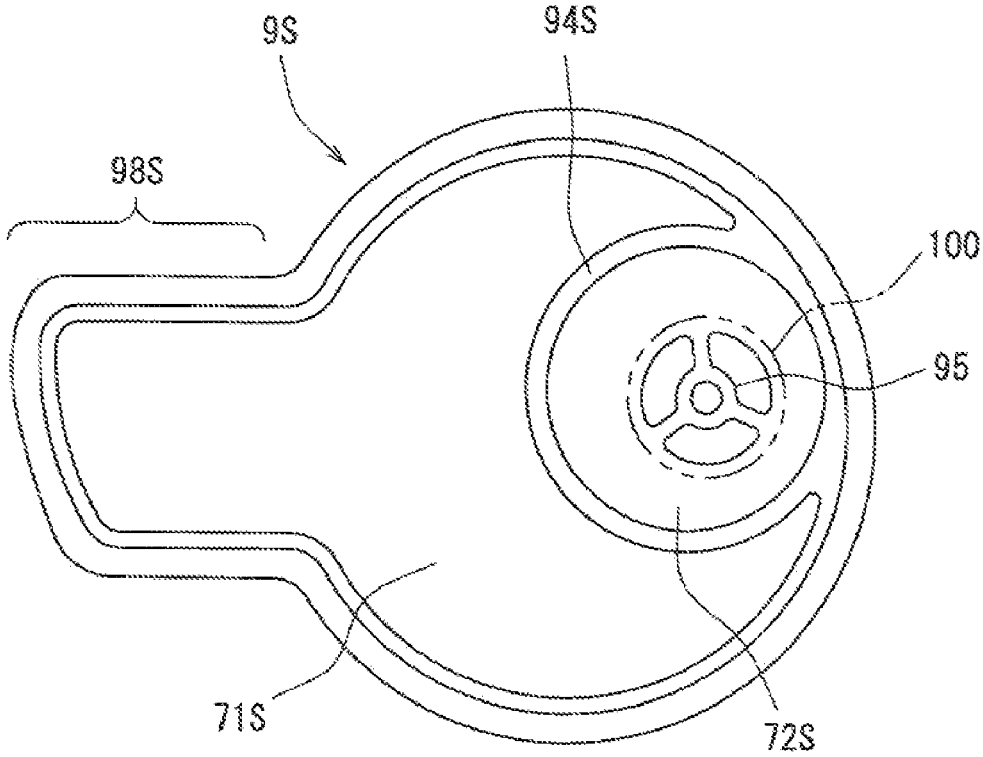
FIG. 23 is a plan view showing a lower casing in FIG. 21.

The projection 94S is formed in a shape shown in FIG. 23 and the second partition wall 82S is also formed in a shape similar to the projection 94S (not shown). As shown in FIG. 23, the lower casing 9S is provided with an extending portion 98S corresponding to the extending portion 73S and is divided by the projection 94S to form a supply fuel flow passage 71S and a pumping-up fuel flow passage 72S therein. The upper casing 8S is provided with an extending portion corresponding to the extending portion 73S and is divided by the second partition wall 82S, which is formed in a shape similar to the projection 94S, to form the supply fuel flow passage 71S and the pumping-up fuel flow passage 72S therein (not shown).

The supply fuel filter 86S is a non-woven cloth made of a material similar to that of the fuel filter 86, 86P, 99 or 99P and is jointed to the upper opening 83S by welding, for example. As described above, the upper opening 83S shown in FIGS. 21 and 22 is extended and enlarged to the extending portion 73S. In consequence, the supply fuel filter 86S is made large to enlarge a filter area of the supply fuel filter 86S. Therefore, it is possible to lengthen the filter lifetime of the supply fuel filter 86S.

It should be noted that instead of the filter assembly 7S provided with the extending portion 73S, by forming the filter assembly in another irregular shape, the filter area of the supply fuel filter 86S can be increased.

Additional advantages and modifications will readily occur to those skilled in the art. The invention in its broader terms is therefore not limited to the specific details, representative apparatus, and illustrative examples shown and described.

What is claimed is:

1. A fuel supply device configured to supply fuel in a fuel tank to an external unit, the device comprising:

a subtank accommodated in the fuel tank, the subtank storing a part of the fuel in the fuel tank;

a fuel pump accommodated in the subtank, the fuel pump having a first pump unit, which is configured to suction fuel in the subtank thereby to supply fuel to the external unit, and a second pump unit, which is configured to suction fuel outside the subtank thereby to pump fuel into the subtank; and a filter member that is connected to a first suction port of the first pump unit and a second suction port of the second pump unit and that is configured to filter the fuel supplied to the external unit and the fuel pumped into the subtank, wherein the filter member includes:

a case having therein a partition wall, which defines a first flow passage and a second flow passage, wherein the first flow passage directs the fuel in the subtank into the first suction port and the second flow passage directs the fuel outside the subtank into the second suction port;

a first filter element disposed in the first flow passage for filtering the fuel supplied to the external unit; and a second filter element disposed in the second flow passage for filtering the fuel pumped into the subtank.

2. The fuel supply device according to claim 1, wherein the case is attached on a bottom surface of the subtank such that:

a first inlet of the first flow passage opens into the subtank; and a second inlet of the second flow passage projects from the bottom surface of the subtank into an outside of the subtank, and opens toward a bottom surface of the fuel tank.

3. The fuel supply device according to claim 2, wherein:

the subtank has an opening on the bottom surface of the subtank; and the case is inserted into the opening so as to be fixed to the subtank.

4. The fuel supply device according to claim 3, wherein:

the case has a flanged portion on a sidewall thereof, and an outer diameter of the flanged portion is larger than an outer diameter of the opening of the subtank; and the flanged portion is formed between the first inlet and the second inlet in a thickness direction of the flanged portion, and is brought into contact with the bottom surface of the subtank when the case is inserted into the opening.

5. The fuel supply device according to claim 2, wherein the first filter element is disposed in the first inlet, and the second filter element is disposed in the second inlet.

6. The fuel supply device according to claim 5, wherein:

the second inlet has a fuel passage on a sidewall thereof, and an outside and an inside of the sidewall of the second inlet communicate through the fuel passage; and the second filter element is disposed to cover the second inlet and the fuel passage.

7. The fuel supply device according to claim 1, wherein:
the first suction port and the second suction port of the fuel pump are formed at one end portion of the fuel pump;
a first outlet of the first flow passage that is connected to the first suction port and a second outlet of the second flow passage that is connected to the second suction port are formed at an end portion of the case; and
the end portion of the case is opposed to the one end portion of the fuel pump.

8. The fuel supply device according to claim 1, further comprising a check valve disposed in the second flow passage, wherein the check valve allows only a flow of fuel from an outside into an inside of the subtank.

9. The fuel supply device according to claim 8, wherein the check valve is disposed on a downstream side of the second filter element in a flow direction of fuel.

10. The fuel supply device according to claim 1 wherein:
the case includes an upper casing, which has an upper partition wall, and a lower casing, which has a lower partition wall and is attached to the upper casing; and
the upper partition wall and the lower partition wall constitute the partition wall when the upper casing and the lower casing are attached to each other to form the case.

11. The fuel supply device according to claim 10, wherein the upper casing and the lower casing are attached to each other by press fitting to form the case.

12. The fuel supply device according to claim 1, wherein a filtration area of the second filter element is larger than a filtration area of the first filter element.

13. A fuel supply device configured to supply fuel in a fuel tank to an external unit, the device comprising:
a subtank accommodated in the fuel tank, the subtank storing a part of the fuel in the fuel tank;
a fuel pump accommodated in the subtank, the fuel pump having a first pump unit, which is configured to suction fuel in the subtank thereby to supply fuel to the external unit, and a second pump unit, which is configured to suction fuel outside the subtank thereby to pump fuel into the subtank; and
a filter member that is connected to a first suction port of the first pump unit for filtering the fuel supplied to the external unit and that is connected to a second suction port of the second pump unit for filtering the fuel pumped into the subtank, wherein the filter member includes:
a case having therein a partition wall, which defines a first flow passage and a second flow passage, wherein the first flow passage directs the fuel in the subtank into the first suction port and the second flow passage directs the fuel outside the subtank into the second suction port through an opening formed on the subtank;
a first filter element disposed in the first flow passage for filtering the fuel supplied to the external unit; and
a second filter element disposed to cover the opening for filtering the fuel pumped into the subtank.

14. The fuel supply device according to claim 13, wherein the case is attached on a bottom surface of the subtank such that:
a first inlet of the first flow passage opens into the subtank; and
a second inlet of the second flow passage projects from the bottom surface of the subtank into an outside of the subtank, and opens toward a bottom surface of the fuel tank.

15. The fuel supply device according to claim 14, wherein:
the opening of the subtank is formed on the bottom surface of the subtank; and
the case of the filter member is inserted into the opening so as to be fixed to the subtank.

16. The fuel supply device according to claim 15, wherein:
the case has a flanged portion on a sidewall thereof, and an outer diameter of the flanged portion is larger than an outer diameter of the opening of the subtank; and
the flanged portion is formed between the first inlet and the second inlet in a thickness direction of the flanged portion, and is brought into contact with the bottom surface of the subtank when the case is inserted into the opening.

17. The fuel supply device according to claim 14, wherein the first filter element is disposed in the first inlet.

18. The fuel supply device according to claim 17, wherein the second inlet has a fuel passage on a sidewall thereof, and an outside and an inside of the sidewall of the second inlet communicate through the fuel passage.

19. The fuel supply device according to claim 13, wherein:
the first suction port and the second suction port of the fuel pump are formed at one end portion of the fuel pump;
a first outlet of the first flow passage that is connected to the first suction port and a second outlet of the second flow passage that is connected to the second suction port are formed at an end portion of the case; and
the end portion of the case is opposed to the one end portion of the fuel pump.

20. The fuel supply device according to claim 13, further comprising a check valve disposed in the second flow passage, wherein the check valve allows only a flow of fuel from an outside into an inside of the subtank.

21. The fuel supply device according to claim 20, wherein the check valve is disposed on a downstream side of the second filter element in a flow direction of fuel.

22. The fuel supply device according to claim 13, wherein:
the case includes an upper casing, which has an upper partition wall, and a lower casing, which has a lower partition wall and is attached to the upper casing; and
the upper partition wall and the lower partition wall constitute the partition wall when the upper casing and the lower casing are attached to each other to form the case.

23. The fuel supply device according to claim 22, wherein the upper casing and the lower casing are attached to each other by press fitting to form the case.

24. The fuel supply device according to claim 13, wherein a filtration area of the second filter element is larger than a filtration area of the first filter element.

25. A fuel supply device configured to supply fuel in a fuel tank to an external unit, the device comprising:
a subtank accommodated in the fuel tank, the subtank storing a part of the fuel in the fuel tank;
a fuel pump accommodated in the subtank, the fuel pump having a first pump unit, which is configured to suction fuel in the subtank thereby to supply fuel to the external unit, and a second pump unit, which is configured to suction fuel outside the subtank thereby to pump fuel into the subtank; and
a filter member that is connected to a first suction port of the first pump unit for filtering the fuel supplied to the external unit and that is connected to a second suction port of the second pump unit for filtering the fuel pumped into the subtank, wherein the filter member includes:
a case having therein a partition wall, which defines a first flow passage and a second flow passage, wherein the first flow passage directs the fuel in the subtank into the first suction port and the second flow passage directs the fuel outside the subtank into the second suction port through an opening formed on the subtank;

a first filter element configured to filter the fuel supplied to the external unit; and a second filter element disposed in the second flow passage for filtering the fuel pumped into the subtank, wherein the second filter element is disposed such that a surface of the second filter element is generally parallel to an inner surface of the subtank, on which the opening is formed.

26. The fuel supply device according to claim 25, wherein the first filter element is disposed in the first flow passage.

27. The fuel supply device according to claim 26, wherein a surface of the first filter element is arranged generally parallel to the surface of the second filter element.

28. The fuel supply device according to claim 27, wherein the first filter element and the second filter element have a plate-like shape.

29. The fuel supply device according to claim 26, wherein:

the inner surface of the subtank is a bottom surface of the subtank; and the case is attached on the bottom surface of the subtank such that:

a first inlet of the first flow passage opens into the subtank; and a second inlet of the second flow passage projects from the bottom surface of the subtank into an outside of the subtank, and opens toward a bottom surface of the fuel tank.

30. The fuel supply device according to claim 29, wherein the case is inserted into the opening of the subtank so as to be fixed to the subtank.

31. The fuel supply device according to claim 30, wherein:

the case has a flanged portion on a sidewall thereof, and an outer diameter of the flanged portion is larger than an outer diameter of the opening of the subtank; and the flanged portion is formed between the first inlet and the second inlet in a thickness direction of the flanged portion, and is brought into contact with the bottom surface of the subtank when the case is inserted into the opening.

32. The fuel supply device according to any one of claims 29, wherein:

the first filter element is disposed in the first inlet; and the second filter element is disposed in the second inlet.

33. The fuel supply device according to claim 32, wherein:

the second inlet has a fuel passage on a sidewall thereof, and an outside and an inside of the sidewall of the second inlet communicate through the fuel passage; and the second filter element is disposed to cover the second inlet and the fuel passage.

34. The fuel supply device according to claim 25, wherein:

the first suction port and the second suction port of the fuel pump are formed at one end portion of the fuel pump;

a first outlet of the first flow passage that is connected to the first suction port and a second outlet of the second flow passage that is connected to the second suction port are formed at an end portion of the case; and the end portion of the case is opposed to the one end portion of the fuel pump.

35. The fuel supply device according to claim 25, further comprising a check valve disposed in the second flow passage, wherein the check valve allows only a flow of fuel from an outside into an inside of the subtank.

36. The fuel supply device according to claim 35, wherein the check valve is disposed on a downstream side of the second filter element in a flow direction of fuel.

37. The fuel supply device according to claim 25, wherein:

the case includes an upper casing, which has an upper partition wall, and a lower casing, which has a lower partition wall and is attached to the upper casing; and the upper partition wall and the lower partition wall constitute the partition wall when the upper casing and the lower casing are attached to each other to form the case.

38. The fuel supply device according to claim 37, wherein the upper casing and the lower casing are attached to each other by press fitting to form the case.

39. The fuel supply device according to claim 25, wherein a filtration area of the second filter element is larger than a filtration area of the first filter element.

* * * * *